US009207556B2

(12) United States Patent
Kosasa et al.

(10) Patent No.: US 9,207,556 B2
(45) Date of Patent: Dec. 8, 2015

(54) IMAGE FORMATION APPARATUS HAVING CLEANING MODE TO CLEAN CHARGING DEVICE CONFIGURED TO CHARGE IMAGE CARRIER

(71) Applicant: Oki Data Corporation, Tokyo (JP)

(72) Inventors: Tsutomu Kosasa, Tokyo (JP); Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/576,359

(22) Filed: Dec. 19, 2014

(65) Prior Publication Data

US 2015/0185681 A1 Jul. 2, 2015

(30) Foreign Application Priority Data

Dec. 26, 2013 (JP) ..... 2013-269820

(51) Int. Cl.
*G03G 15/00* (2006.01)
*G03G 15/02* (2006.01)

(52) U.S. Cl.
CPC ..... *G03G 15/0225* (2013.01)

(58) Field of Classification Search
CPC ..... G03G 15/0225; G03G 15/0258; G03G 15/5045; G03G 21/21; G03G 21/203
USPC ..... 399/43, 44, 100
See application file for complete search history.

(56) References Cited

U.S. PATENT DOCUMENTS 5,689,770 A * 11/1997 Kurokawa et al. ..... 399/100

FOREIGN PATENT DOCUMENTS

JP 2000-259057 A 9/2000

* cited by examiner

*Primary Examiner* — William J Royer
(74) *Attorney, Agent, or Firm* — Marvin A. Motsenbocker; Mots Law, PLLC

(57) ABSTRACT

An image formation apparatus includes an image carrier, a charge device configured to charge the surface of the image carrier, a development device configured to pass a developer to an electrostatic latent image on the image carrier formed by exposure, a transfer device configured to transfer a developer image formed on the image carrier onto a medium, a remover device configured to remove the developer on the image carrier, and a controller configured to control a cleaning mode for removing extraneous matter adhered to the surface of the charge device at a time other than the time for the process of exposing the image carrier, and to change the execution frequency of the cleaning mode in accordance with an environmental condition.

16 Claims, 12 Drawing Sheets

FIG. 6

| | TEMPERATURE (°C) | HUMIDITY (%) | AMOUNT OF VAPOR WATER (g/m3) | CLEANING MODE EXECUTION FREQUENCY (PER) | SURFACE POTENTIAL (V) | VISUAL OBSERVATION RESULT OF PRINTS |
|---|---|---|---|---|---|---|
| TEST 1 | 25 | 50 | 11.53 | 60 | 1 | ◎ |
| TEST 2 | 25 | 50 | 11.53 | 0 | 20 | ○ |
| TEST 3 | 25 | 25 | 5.77 | 60 | 2 | ◎ |
| TEST 4 | 25 | 60 | 13.84 | 60 | 1 | ◎ |
| TEST 5 | 25 | 20 | 4.61 | 60 | 10 | ○ |
| TEST 6 | 25 | 65 | 14.99 | 60 | 8 | ○ |
| TEST 7 | 25 | 70 | 16.14 | 60 | 12 | × |
| TEST 8 | 25 | 70 | 16.14 | 12 | 1 | ◎ |
| TEST 9 | 30 | 20 | 6.08 | 60 | 18 | × |
| TEST 10 | 30 | 20 | 6.08 | 12 | 3 | ◎ |
| TEST 11 | 30 | 50 | 15.19 | 60 | 18 | × |
| TEST 12 | 30 | 50 | 15.19 | 12 | 3 | ◎ |
| TEST 13 | 30 | 80 | 24.3 | 60 | 18 | × |
| TEST 14 | 30 | 80 | 24.3 | 12 | 3 | ◎ |
| TEST 15 | 10 | 20 | 1.88 | 60 | 15 | × |
| TEST 16 | 10 | 20 | 1.88 | 12 | 2 | ◎ |
| TEST 17 | 30 | 20 | 6.08 | 12 | 10 or lower | ◎ |
| TEST 18 | 25 | 25 | 5.77 | 60 | 2 | ◎ |
| TEST 19 | 25 | 25 | 5.77 | 60 | – | – |
| TEST 20 | 25 | 25 | 5.77 | 60 | | × |

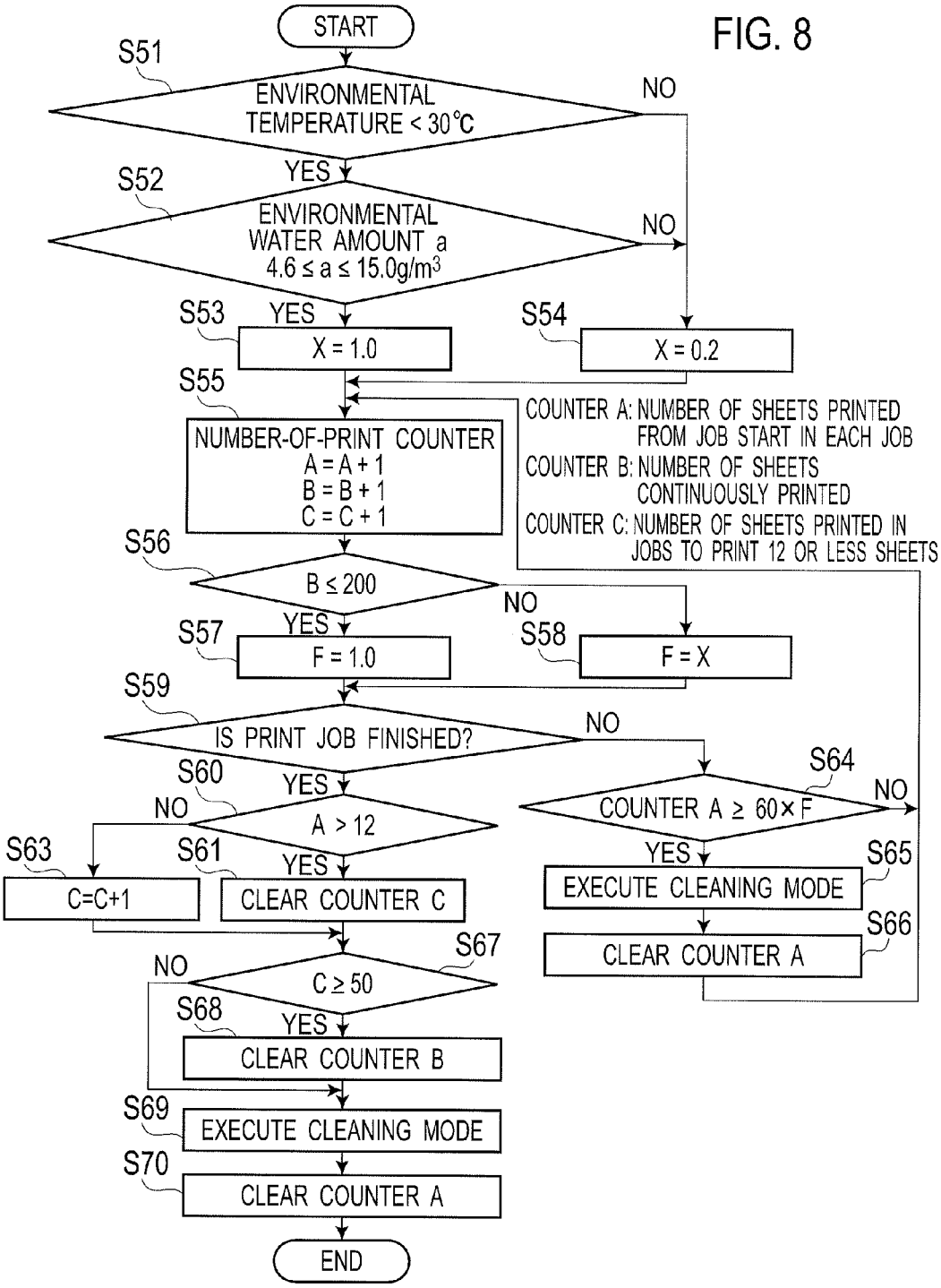
FIG. 8
START
S51
ENVIRONMENTAL TEMPERATURE < 30℃
NO
YES
S52
ENVIRONMENTAL WATER AMOUNT a
4.6 ≤ a ≤ 15.0g/m3
NO
S53
YES
X = 1.0
S54
X = 0.2
S55
NUMBER-OF-PRINT COUNTER
A = A + 1
B = B + 1
C = C + 1
COUNTER A: NUMBER OF SHEETS PRINTED FROM JOB START IN EACH JOB
COUNTER B: NUMBER OF SHEETS CONTINUOUSLY PRINTED
COUNTER C: NUMBER OF SHEETS PRINTED IN JOBS TO PRINT 12 OR LESS SHEETS
S56
B ≤ 200
NO
YES
S57
F = 1.0
S58
F = X
S59
IS PRINT JOB FINISHED?
NO
S60
YES
NO
A > 12
S63
C=C+1
S61
YES
CLEAR COUNTER C
S64
COUNTER A ≥ 60 × F
NO
YES
S65
EXECUTE CLEANING MODE
S66
CLEAR COUNTER A
S67
NO
C ≥ 50
S68
YES
CLEAR COUNTER B
S69
EXECUTE CLEANING MODE
S70
CLEAR COUNTER A
END

FIG. 10

| SENSOR READING | | HUMIDITY H (%) | | | | | | | | |
|---|---|---|---|---|---|---|---|---|---|---|
| | | H<15 | 15≤H<25 | 25≤H<35 | 35≤H<45 | 45≤H<55 | 55≤H<65 | 65≤H<75 | 75≤H<85 | 85≤H |
| TEMPERATURE T (℃) | T<5 | 8 | 8 | 8 | 7 | 7 | 7 | 7 | 6 | 6 |
| | 5≤T<10 | 8 | 8 | 8 | 7 | 7 | 6 | 6 | 5 | 5 |
| | 10≤T<15 | 8 | 8 | 7 | 7 | 6 | 6 | 5 | 4 | 4 |
| | 15≤T<20 | 8 | 7 | 7 | 6 | 5 | 4 | 4 | 3 | 3 |
| | 20≤T<25 | 7 | 7 | 6 | 5 | 4 | 4 | 3 | 3 | 2 |
| | 25≤T<30 | 7 | 6 | 5 | 4 | 4 | 3 | 1 | 1 | 1 |
| | 30≤T<35 | 7 | 6 | 5 | 4 | 2 | 1 | 1 | 1 | 1 |
| | 35≤T<40 | 6 | 6 | 4 | 2 | 1 | 1 | 1 | 1 | 1 |
| | 40≤T | 6 | 5 | 4 | 2 | 1 | 1 | 1 | 1 | 1 |

FIG. 11

| | 1≤e<2 | 2≤e<3 | 3≤e<4 | 4≤e<5 | 5≤e<6 | 6≤e<7 | 7≤e<8 |
|---|---|---|---|---|---|---|---|
| x | 75 | 75 | 96 | 96 | 96 | 75 | 75 |
| y | 60 | 60 | 77 | 77 | 77 | 60 | 60 |
| z | 50 | 50 | 64 | 64 | 64 | 50 | 50 |
| a | 1.0 | 1.0 | 1.0 | 1.0 | 1.0 | 1.0 | 1.0 |
| b | 0.6 | 0.6 | 1.0 | 1.0 | 1.0 | 0.2 | 0.2 |
| h | 1.0 | 1.0 | 1.0 | 1.0 | 1.0 | 1.0 | 1.0 |
| i | 0.6 | 0.6 | 0.6 | 0.6 | 0.6 | 0.6 | 0.6 |
| d | 200 | 200 | 200 | 200 | 200 | 200 | 200 |
| s | 10 | 10 | 10 | 10 | 10 | 10 | 10 |

IMAGE FORMATION APPARATUS HAVING CLEANING MODE TO CLEAN CHARGING DEVICE CONFIGURED TO CHARGE IMAGE CARRIER

CROSS REFERENCE TO RELATED APPLICATIONS

This application claims priority based on 35 USC 119 from prior Japanese Patent Application No. 2013-269820 filed on Dec. 26, 2013, entitled "IMAGE FORMATION APPARATUS", the entire contents of which are incorporated herein by reference.

BACKGROUND OF THE INVENTION

1. Field of the Invention

This disclosure relates to an image formation apparatus.

2. Description of Related Art

In a conventional image formation apparatus, an image is developed using toner (a developer) on the surface of a photoreceptor drum, and in some cases, a part of the toner is not properly transferred and remains on the surface of the photoreceptor drum. The remaining toner is removed by a cleaning blade in a process after the process of transfer to the surface of the photoreceptor drum. However, some of the toner not removed by the cleaning blade further adheres to the surface of a charge roller on a downstream side in the rotation direction of the photoreceptor drum.

The image formation apparatus removes the toner on the charge roller by executing a cleaning mode. In the cleaning mode, a different bias from that applied in the printing process is applied to the charge roller in order to remove the toner adhered to the surface of the charge roller (hereinafter, also referred to as extraneous matter) (see Japanese Patent application Publication No. 2000-259057, for example).

SUMMARY OF THE INVENTION

However, with an increase in the working speed and life span of image formation apparatuses, much more external additives need to be added to the toner in order to provide a high durability of the toner and a high performance of the cleaning toner particles. In this case, the external additives, which are composed of smaller particles than the toner particles, can slip past the cleaning blade and adhere to a charge device. This causes a failure in charging the photoreceptor drum, thus leading to image defects.

An object of an embodiment of the invention is to efficiently remove the extraneous matter that adhered to the charge device and minimize the degradation of throughput by optimizing the execution frequency of the cleaning mode.

An aspect of the invention is an image formation apparatus that includes: an image carrier; a charge device configured to charge the surface of the image carrier; a development device configured to pass a developer to an electrostatic latent image on the image carrier formed by exposure; a transfer device configured to transfer a developer image formed on the image carrier onto a medium; a remover device configured to remove the developer on the image carrier; and a controller configured to control the cleaning mode of removing extraneous matter adhered to the surface of the charge device, the removal being performed at a time other than the time for the process of exposing the image carrier, and to change the execution frequency of the cleaning mode in accordance with an environmental condition.

According to this aspect of the invention, it is possible to efficiently remove extraneous matter, such as toner's external additives, adhered to the charge device while minimizing degradation of the throughput.

BRIEF DESCRIPTION OF THE DRAWINGS

FIG. 6 is a table showing test results in accordance with environmental variations using the image formation apparatus according to the first embodiment.

FIG. 8 is an operation flowchart in the case of changing the execution frequency of the cleaning mode in accordance with the environmental conditions under which the image formation apparatus is located and whether comparatively short print jobs are successive in the image formation apparatus according to the first embodiment.

FIG. 10 is an explanatory diagram for explaining an environmental value e according to the second embodiment.

FIG. 11 is an explanatory diagram for explaining various parameters according to the second embodiment.

DETAILED DESCRIPTION OF EMBODIMENTS

Figure 1:
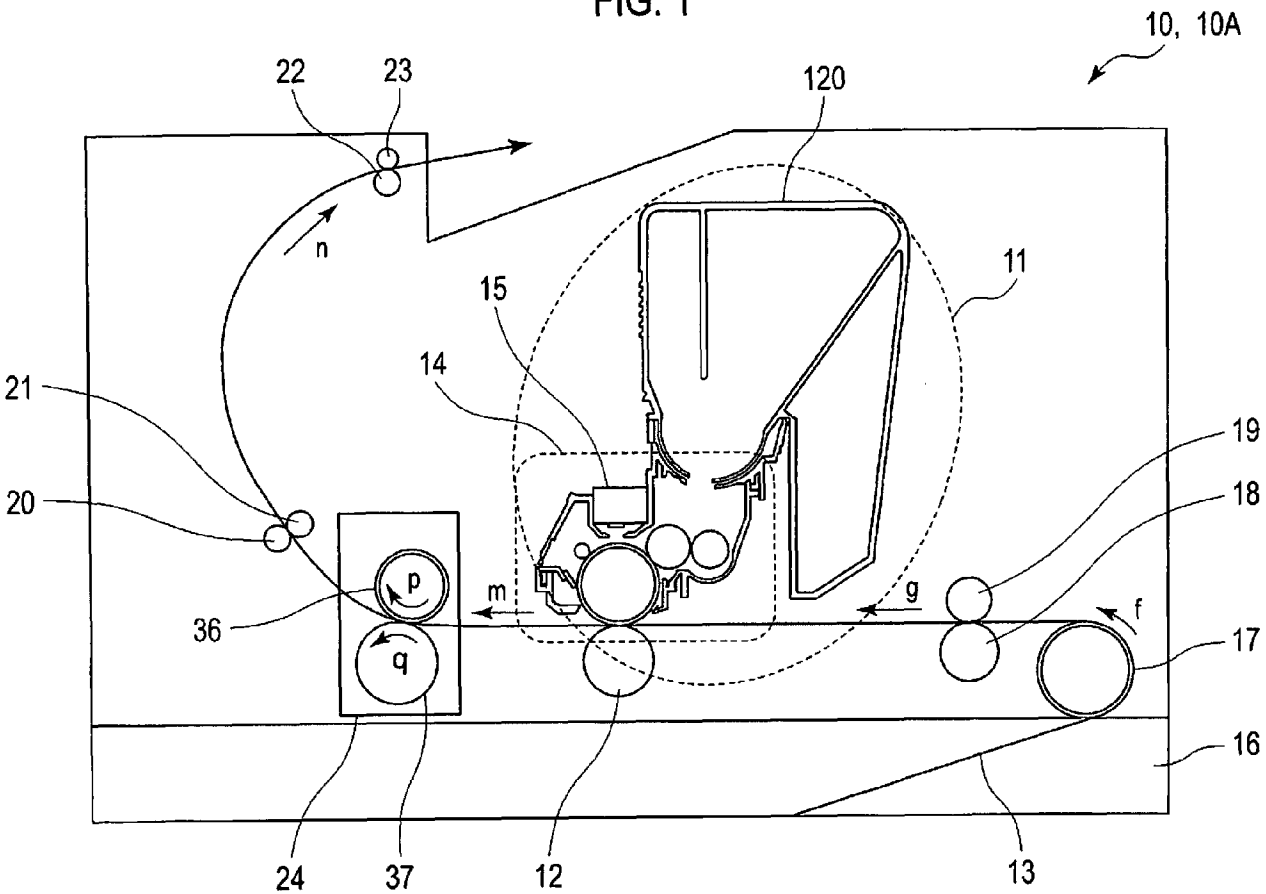
FIG. 1 is a schematic configuration diagram for explaining the configuration of a major part within an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) First Embodiment

Hereinafter, a description is given of a first embodiment of an image formation apparatus of the invention in detail with reference to the drawings.

The first embodiment is described by assuming that the image formation apparatus according to the invention is an electrophotographic printer. However, the invention is not limited to electrophotographic printers. The invention is applicable to a wide variety of image formation apparatuses and can be applied to electrophotographic copiers, facsimiles, and the like, for example.

A "normal temperature and normal humidity environment" refers to an environment in which an environment water amount "a" is in the range of $4.6\ g/m^3 \leq a \leq 15.0\ g/m^3$ and is an environment with a temperature of 25° C. and a humidity of 40%, for example. A "high-temperature and high-humidity environment (hereinafter, referred to as an HH environment)" refers to an environment in which the environment water amount a is in the range of $15.0\ g/m^3 < a$ and is an environment with a temperature of 28° C. and a humidity of 70%, for example. A "low-temperature and low-humidity environment (hereinafter, referred to as an LL environment)" refers to an environment in which the environment water amount a is in the range of $a < 4.6\ g/m^3$ and is an environment with a temperature of 10° C. and a humidity of 30%, for example.

(A-1) Configuration of First Embodiment

(A-1-1) Internal Configuration of Image Formation Apparatus

FIG. 1 is a schematic configuration diagram for explaining the configuration of a major part within the image formation apparatus according to the first embodiment.

In FIG. 1, image formation apparatus 10 according to the first embodiment includes recording sheet cassette 16, image formation unit 11, transfer portion 12 as a transfer device, and fixing portion 24. Image formation apparatus 10 further includes paper transport rollers 17 to 23 which transport recording sheets 13 as print media to the aforementioned constituent elements.

Image formation apparatus 10 of FIG. 1 includes the single image formation unit 11 and performs image formation with a developer (toner) of a single color by way of example. However, image formation apparatus 10 may include image formation units 11 accommodating toners of different colors and form color toner images.

Recording sheet cassette 16 accommodates recording sheets 13 stacked on one another inside. Recording sheet cassette 16 is detachably attached within a lower part of image formation apparatus 10, for example.

Paper transport roller 17 picks up recording sheets 13 accommodated in recording sheet cassette 16 from the topmost sheet one by one and feeds the same in the direction of arrow f in FIG. 1. Recording sheets 13 can be thus fed to a paper transport path. Paper transport rollers 18 and 19 transport recording sheets 13 in the direction of arrow g in FIG. 1 to an image formation portion 14. Arrows f, g, m, and n illustrated in FIG. 1 schematically indicate the path on which recording sheets 13 are transported.

Image formation unit 11 includes: toner cartridge 120 as a developer housing; image formation portion 14 as a developer device detachably located along the sheet transport path; LED (light emitting diode) head 15 as an exposure device; and transfer portion 12 which transfers a developer image (hereinafter, referred to as a toner image) formed by the image formation portion 14 onto the upper surface of each recording sheet 13 by the Coulomb force therebetween.

Toner cartridge 120 accommodates toner as a developer and supplies the toner to image formation portion 14. Toner cartridge 120 is detachably attached to image formation unit 11. Image formation unit 11 is detachably attached at a predetermined position of image formation apparatus 10.

Transfer portion 12 is provided in pressure contact with photoreceptor drum 101 (see FIG. 2) of image formation unit 11 so as to face photoreceptor drum 101. Transfer portion 12 is subjected to a voltage to transfer the toner image on the upper surface of photoreceptor drum 101 onto each recording sheet 13.

Figure 2:
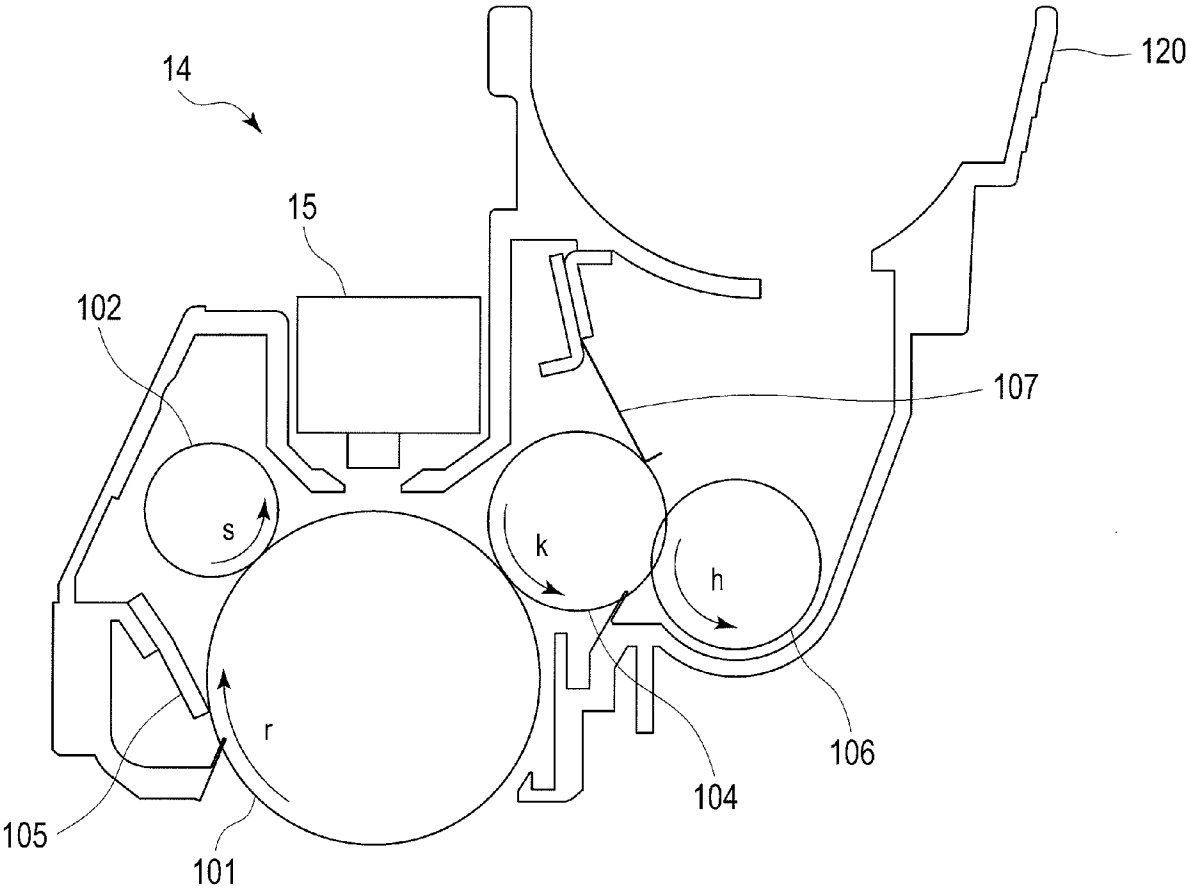
FIG. 2 is a configuration diagram illustrating the configuration of an image formation portion according to the first embodiment.

FIG. 2 is a configuration diagram illustrating the configuration of image formation portion 14 according to the first embodiment. FIG. 2 also shows LED head 15 provided in the vicinity of image formation portion 14.

In FIG. 2, image formation portion 14 according to the first embodiment includes: development roller 104 as a developer supporting body; supply roller 106 as a supply member; development blade 107 as a layer control member; toner cartridge 120; photoreceptor drum 101 as an image carrier; charge roller 102 as a charge member; and cleaning blade 105 as a remover device (a cleaning member) which is brought into pressure contact with the surface of photoreceptor drum 101.

After the surface of photoreceptor drum 101 is charged by charge roller 102, photoreceptor drum 101 is exposed to light from LED head 15 to form an electrostatic latent image. On the photoreceptor drum 101, toner is transferred to the formed latent image to form a toner image. Photoreceptor drum 101 rotates in the direction of arrow r in FIG. 2. Photoreceptor drum 101 can be an inorganic photoreceptor drum which includes a photosensitive layer made of selenium or amorphous silicone, for example, on a conductive base roller made of aluminum, for example; or an organic photoreceptor drum which includes the aforementioned conductive base roller with an organic photosensitive layer thereon that is composed of binder resin with a charge generation agent or a charge transport agent dispersed, or the like. In the example shown in the first embodiment, photoreceptor drum. 101 is an organic photoreceptor drum including a conductive base roller and a photosensitive layer, in which a charge generation layer and a charge transport layer as the photosensitive layer are sequentially stacked on a metallic pipe made of aluminum as the conductive base roller. To be more specific, photoreceptor drum 101 includes an aluminum pipe with a diameter of 30 mm and a 22 μM thick photosensitive layer laid on the pipe.

Charge roller 102 is provided in contact with the circumferential surface of photoreceptor drum 101 and charges the surface of photoreceptor drum 101. Charge roller 102 rotates in the direction of arrow s in FIG. 2. Charge roller 102 includes a metallic shaft and semiconducting epichlorohydrin rubber, for example.

LED head 15 is configured to expose the surface of photoreceptor drum 101 based on print data. LED head 15 includes an LED element and a lens array, for example, and is located at such a position that irradiation light emitted from the LED element is focused on the surface of photoreceptor drum 101.

Development roller 104 is provided in contact with the circumferential surface of photoreceptor drum 101 and is configured to pass toner provided from supply roller 106, to an electrostatic latent image on the surface of photoreceptor drum 101 for developing the latent image. Development roller 104 rotates in the direction of arrow k. Development roller 104 includes members used in conventional development rollers which includes a conductive base shaft made of stainless steel, for example, and a semiconducting layer that is made of silicone rubber or urethane rubber, for example, to adjust the electric resistance with carbon. In the example shown in the first embodiment, development roller 104 includes a conducting base shaft and a semiconducting urethane rubber layer.

Supply roller 106 is provided in sliding contact with development roller 104 and is configured to supply toner to development roller 104. Supply roller 106 rotates in the direction of arrow h in FIG. 2. Supply roller 106 includes members used in supply rollers of the existing technique, such as a conducting base shaft made of stainless steel, for example, and a semiconducting silicone foam sponge layer or semiconducting urethane foam sponge layer as an elastic layer. In the example shown in the first embodiment, the supply roller 106 includes a conducting base shaft and a semiconducting silicone foam sponge layer as the elastic layer.

Development blade 107 is provided in pressure contact with the surface of development roller 104 and is configured to control the amount of toner that adheres to the surface of development roller 104. Development blade 107 is made of a material used in development blades of existing techniques, such as a metal including stainless steel or phosphor bronze and a rubber material including silicone rubber. Development blade 107 may be subjected to an appropriate voltage.

Cleaning blade 105 is made of an elastic material such as urethane rubber, epoxy rubber, acrylic rubber, fluorine resin rubber, nitrile butadiene rubber (NBR), styrene butadiene rubber (SBR), isoprene rubber (IR), and polybutadiene rubber. In the example of the first embodiment, the cleaning blade 105 is made of urethane rubber.

In FIG. 1, recording sheet 13 onto which a toner image is transferred by image formation portion 14 is transported in the direction of arrow m in FIG. 1 to be fed to fixing portion 24.

Fixing portion 24 is configured to fix the toner image transferred onto one side of recording sheet 13. Fixing portion 24 includes heating roller 36 and pressure roller 37.

Heating roller 36 has a configuration in which a hollow cylindrical core made of aluminum is covered with a heat-resistant elastic layer of silicone rubber, which is covered with PFA (tetrafluoroethylene-perfluoroalkylvinyl ether copolymer) tube, for example. Heating roller 36 is provided with a heater, such as a halogen lamp, for example in the core and generates heat.

Pressure roller 37 has, for example, a configuration in which an aluminum core is covered with a heat-resistant elastic layer of silicone rubber and the heat-resistant elastic layer is covered with a PFA tube. Pressure roller 37 is located so as to form a pressure contact portion with heating roller 36.

(A-1-2) Toner as Developer

Next, a description is given of the toner used as the developer in the first embodiment.

The toner as the developer includes toner base particles containing at least a binder resin with external additives of inorganic or organic fine powder added thereto. The toner is accommodated in toner cartridge 120 as the developer housing.

The binder resin, which is not particularly limited, is preferably polyester resin, styrene-acrylic resin, epoxy resin, or styrene-butadiene resin, for example. The binder resin is added with a release agent, a colorant, and the like and may be further added with external additives such as a charge control agent, a conductivity control agent, a flow improver, and a cleaning property improver as needed.

The release agent contained in the binder resin, which is not particularly limited, is a publicly known substance such as paraffin wax or carnauba wax, for example. The content of the release agent in the binder resin can be 0.1 to 20 parts by weight relative to 100 parts by weight of the binder resin. Preferably, it is effective that the content of the release agent in the binder resin is 0.5 to 12 parts by weight. The release agent can include either one or multiple kinds of wax.

The colorant, which is not particularly limited, can be existing dies and pigments used as colorants for black, yellow, magenta, and cyan toners, for example. The colorant may include a kind of, or plural kinds of, dies and pigments. To be specific, examples of the colorant are carbon black, iron oxide, phthalocyanine blue, Permanent Brown FG, Brilliant Fast Scarlet, Pigment Green B, Rhodamine-B base, Solvent Red 49, Solvent Red 146, Pigment Blue 15:3, Solvent Blue 35, quinacridone, carmine 6B, and disazo yellow. The content of the colorant can be 2 to 25 parts by weight to 100 parts by weight of the binder resin and is preferably 12 to 15 parts by weight.

The charge control agent can be an existing agent. Examples of the charge control agent are azo complex charge control agents, salicylate complex charge control agents, calixarene charge control agents, and quaternary ammonium salt charge control agents. The content of the charge control agent is 0.05 to 15 parts by weight relative to 100 parts by weight of the binder resin and is preferably 0.1 to 10 parts by weight. The charge control agent can include one kind or multiple kinds of agents in combination.

The external additives are added to increase the environmental stability, charging stability, developability, fluidity, and conservation and can be known types of external additives. Examples of the external additives can be silica, titania, alumina, and resin fine particles. The content of the external additives can be 0.01 to 10 parts by weight relative to 100 parts by weight of the binder resin and is preferably 0.05 to 8 parts by weight. The external additives can include either one kind or multiple kinds of additives in combination. Moreover, the additives have a polarity opposite to the later-described bias applied to the charge device during printing.

The toner can be manufactured by various types of manufacturing processes, which are not particularly limited. The method of manufacturing the toner according to the first embodiment is implemented substantially as follows.

First, the binder resin (polyester resin, number average molecular weight Mn=3700, glass transition temperature Tg=62° C., and softening temperature T½=115° C.) of 100 parts by weight is added with 0.5 parts by weight of Bontron E84 (ORIENT CHEMICAL INDUSTRIES CO., LTD.) as the charge control agent, 5.0 parts by weight of carbon black as the colorant, and 4.0 parts by weight of carnauba wax (Carnauba Wax No. 1 powder, S. KATO & CO.) as the release agent. The mixture is blended with a Henschel mixer and then melted and kneaded with a twin-screw extruder. After being cooled, the obtained product is crushed with a cutter mill with a screen hole diameter of 2 mm and is then ground with a collision plate type mill "Dispersion separator" (Nippon Pneumatic Mfg. Co., Ltd.). The obtained particles are classified using an air classifier, thus obtaining toner base particles with an average particle size of 6.0 μM.

Next in the process of external additives, 1 kg of the obtained toner base particles (100 parts by weight) are added with 3.0 parts by weight of hydrophobic silica R972 (NIPPON AEROSIL CO., LTD., the average particle size=16 nm) and 0.3 parts by weight of melamine resin fine particles EPOSTER S (NIPPON SHOKUBAI CO., LTD., average particle size=0.2 μM, the amount of charge=+212 (μC/g)). The mixture is then stirred with a Henschel mixer for three minutes, thus obtaining a negatively-charged toner.

Figure 3:
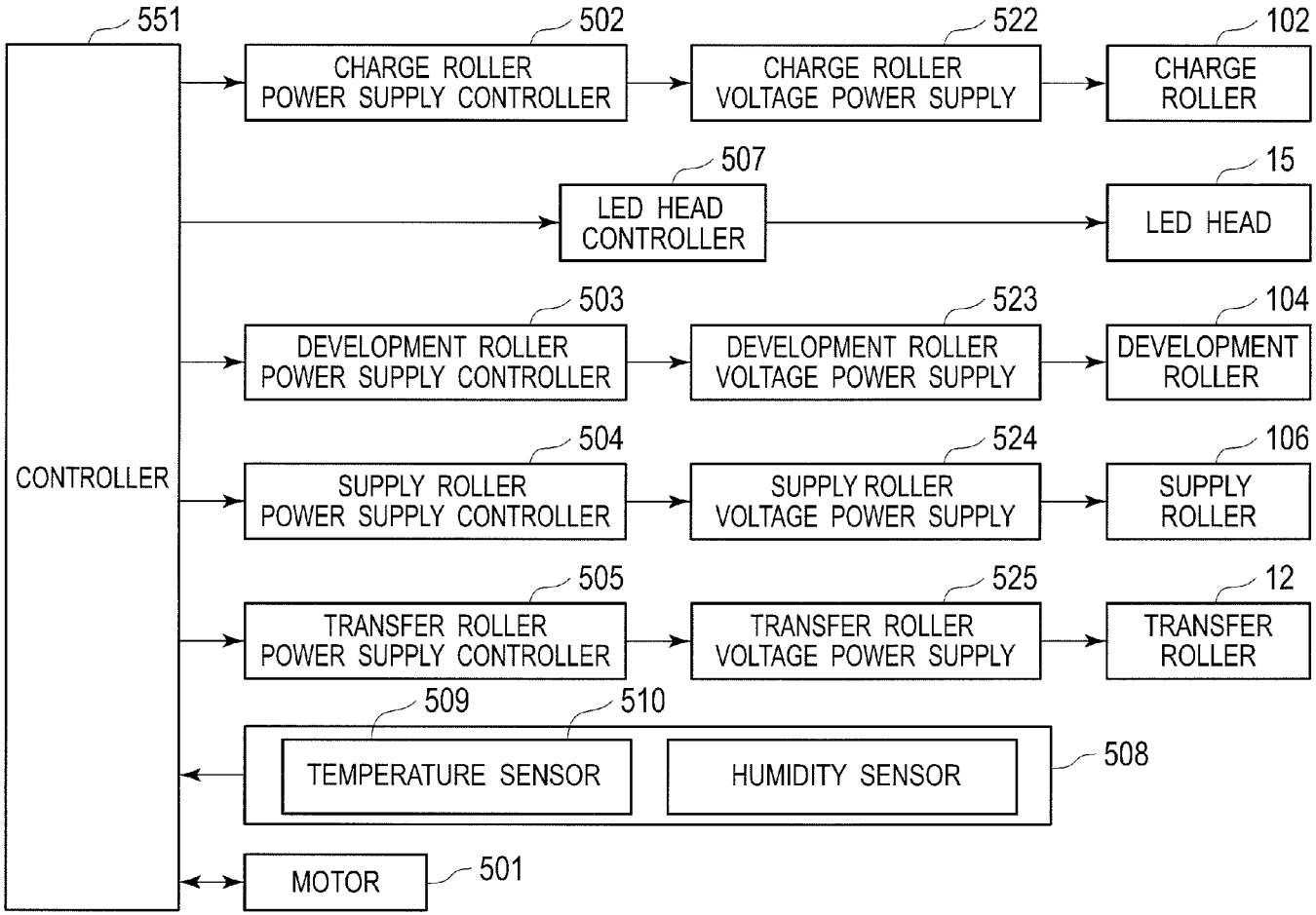
FIG. 3 is a block diagram illustrating the configuration of a control system of the image formation apparatus according to the first embodiment.

(A-1-3) Configuration of the Control System of the Image Formation Apparatus FIG. 3 is a block diagram illustrating the configuration of the control system of image formation apparatus 10 according to the first embodiment. The constituent components illustrated in FIG. 3 that are the same as, or correspond to, those illustrated in FIGS. 1 and 2 are given the same or corresponding reference numerals.

In FIG. 3, image formation apparatus 10 according to the first embodiment mainly includes controller 551, charge roller power supply controller 502, charge roller voltage power supply (CHB) 522, charge roller 102, LED head controller 507, LED head 15, development roller power supply controller 503, development roller voltage power supply (DB) 523, development roller 104, supply roller power supply controller 504, supply roller voltage power supply (SB) 524, supply roller 106, transfer roller power supply controller 505, transfer roller voltage power supply (TRB) 525, transfer roller 12, motor 501, and sensor portion 508.

Herein, the charge device includes charge roller power supply controller 502, charge roller voltage power supply (CHB) 522, and charge roller 102. The "development device" includes development roller power supply controller 503, development roller voltage power supply (DB) 523, and development roller 104. The "transfer device" includes transfer roller power supply controller 505, transfer roller voltage power supply (TRB) 525, and transfer roller 12.

Controller 551 controls the entire function of image formation apparatus 10. Controller 551 includes a microprocessor, a ROM, a RAM, an input/output interface, a timer, and the like, for example. Controller 551 acquires print data and control commands from an upper-level apparatus and performs a sequential control of the entire image formation apparatus 10 for the printing operation.

Motor 501 is a driving unit instructed by controller 551 to drive photoreceptor drum 101, charge roller 102, development roller 104, supply roller 106, and transfer roller 12. Motor 501 is instructed by controller 551 to be turned on/off.

Sensor portion 508 is configured to sense the temperature and humidity of the environment where image formation apparatus 10 is placed and give sensing data to controller 551. Sensor portion 508 includes temperature sensor 509 and humidity sensor 510.

Charge roller power supply controller 502 is instructed by controller 551 to control the application voltage from charge roller voltage power supply (CHB) 522. Charge roller power supply controller 502 performs an application voltage control to apply voltage to charge roller 102 and charge the surface of photoreceptor drum 101 (see FIG. 2).

LED head controller 507 is instructed by controller 551 to perform an exposure control for LED head 15 in accordance with print data. To be specific, LED head controller 507 performs such a control that LED head 15 (see FIGS. 1 and 2) projects light and exposes the charged surface of photoreceptor drum 101 (see FIG. 2) in accordance with the print data and creates an electrostatic latent image.

Development roller power supply controller 503 is instructed by controller 551 to perform an application voltage control for development roller voltage power supply (DB) 523. To be specific, development roller power supply controller 503 performs an application voltage control to apply voltage to development roller 104 for attaching toner to the electrostatic latent image generated by LED head 15 on the surface of photoreceptor drum 101 (see FIG. 2).

Supply roller power supply controller 504 is instructed by controller 551 to perform an application voltage control for supply roller voltage power supply (SB) 524. To be specific, supply roller power supply controller 504 performs an application voltage control to apply voltage to supply roller 106 for supplying toner to development roller 104 (see FIG. 2).

Transfer roller power supply controller 505 is instructed by controller 551 to perform an application voltage control for transfer roller voltage power supply (TRB) 525. To be specific, transfer roller power supply controller 505 performs an application voltage control to apply voltage to transfer roller 12 (see FIGS. 1 and 2) for transferring the toner image generated on the surface of photoreceptor drum 101 to recording sheet 13.

Charge roller voltage power supply (CHB) 522 applies a direct-current voltage to charge roller 102 by the application voltage control of charge roller power supply controller 502.

Development roller voltage power supply (DB) 523 applies a direct-current voltage to development roller 104 by the application voltage control of development roller power supply controller 503 to form a toner image on photoreceptor drum 101 exposed by light from LED head 15.

Supply roller voltage power supply (SB) 524 applies a direct-current voltage to supply roller 106 by the application voltage control of supply roller power supply controller 504.

Transfer roller voltage power supply (TRB) 525 applies a direct-current voltage to transfer roller 12 by the application voltage control of transfer roller power supply controller 505 to transfer the toner image formed by image formation unit 11 onto recording sheet 13.

(A-2) Operation of First Embodiment

Next, a description is given of the operation of image formation apparatus 10 according to the first embodiment in detail with reference to the drawings.

(A-2-1) Operation in Printing Mode

First, the operation of the printing mode in image formation apparatus 10 is described.

In FIG. 2, photoreceptor drum 101 is rotated at a predetermined circumferential velocity in the direction of arrow r of FIG. 2 by motor 501 as the driving unit.

Charge roller 102, which is provided in contact with the surface of photoreceptor drum 101, rotates in the direction of arrow s of FIG. 2 while being supplied with a direct-current voltage of about −1000 V by charge roller voltage power supply (CHB) 522 (see FIG. 3). The supplied voltage of about −1000 V is applied to the surface of photoreceptor drum 101, and the surface of photoreceptor drum 101 is uniformly charged to −500 V. Charge roller 102 rotates in the opposite direction to that of photoreceptor drum 101, and the circumferential velocity of the surface of charge roller 102 is equal to that of photoreceptor drum 101.

Next, light corresponding to print data is projected onto the uniformly charged surface of photoreceptor drum 101 by LED head 15, which is provided facing photoreceptor drum 101, to cause a light discharge. The potential of the irradiated part is thereby reduced to about −100 V, thus forming an electrostatic latent image.

Toner is supplied from toner cartridge 120 to image formation portion 14. Supply roller 106 is supplied with a direct-current voltage by supply roller voltage power supply (SB) 524 (see FIG. 3) to rotate in the direction of arrow h in FIG. 2 and transport the toner. The toner is thus supplied to development roller 104. Supply roller 106 rotates in the same direction as development roller 104, and the ratio in surface circumferential velocity of supply roller 106 to development roller 104 is set to 0.66.

Development roller 104 is provided in contact with photoreceptor drum 101 and is supplied with a direct-current voltage by development roller voltage power supply (DB) 523

(see FIG. 3). Development roller 104 adsorbs toner transported by supply roller 106 and rotates in the direction of arrow k in FIG. 2 to transport toner.

In this rotation and transport process, development blade 107, which is located downstream of supply roller 106 in contact with development roller 104, levels toner adsorbed on development roller 104 to form a toner layer having an even thickness on development roller 104. The amount of toner in the toner layer during the printing process is set to 0.30 to 0.50 $mg/cm^2$. This is because if the amount of toner is less than the above range, the density is excessively low. If the amount of toner is more than the above range, the toner developed is too much for the latent image on the surface of photoreceptor drum 101, thus causing a so-called dot stain and the like and thereby degrading the image resolution. In this process, the toner in the toner layer on the surface of development roller 104 is charged by friction due to the slide of development roller 104 on supply roller 106 or pressure contact of development blade 107. Development roller 104 rotates in the opposite direction to photoreceptor drum 101. The ratio in surface circumferential velocity of development roller 104 to photoreceptor drum 101 is 1.26.

The electrostatic latent image formed on the surface of photoreceptor drum 101 is reversal-developed by toner supported on development roller 104. Between photoreceptor drum 101 and development roller 104, a bias voltage is applied by the high-voltage power supply. Accordingly, lines of electric force due to the electrostatic latent image formed on photoreceptor drum 101 are provided between photoreceptor drum 101 and development roller 104. The charged toner on the surface of development roller 104 therefore adheres to the portion of the electrostatic latent image on the surface of photoreceptor drum 101 by the Coulomb force therebetween, thus developing this portion to form a toner image.

On the other hand, as illustrated in FIG. 1, recording sheets 13 accommodated in recording sheet cassette 16 are taken out by paper transport roller 17 from recording sheet cassette 16 one by one in the direction of arrow f in FIG. 1. Each recording sheet 13 is transported along a not-shown recording sheet guide in the direction of arrow g in FIG. 1 by paper transport rollers 18 and 19 with the skew of recording sheet 13 being corrected. Recording sheet 13 is thus fed to image formation portion 14.

In image formation portion 14, transfer roller 12 is located facing photoreceptor drum 101 and is in pressure contact with the same as illustrated in FIG. 2. Transfer roller 12 is subjected to a direct-current voltage by transfer roller voltage power supply (TRB) 525 (see FIG. 3). A transfer process to transfer the toner image formed on photoreceptor drum 101 onto recording sheet 13 is performed by transfer roller 12. These development and transfer processes are performed at predetermined times described later.

Recording sheet 13 onto which the toner image is transferred is transported in the direction of arrow min FIG. 1 to be fed to fixing portion 24. Recording sheet 13 goes between heating roller 36 rotating in the direction of arrow p in FIG. 1 and pressure roller 37 rotating in the direction of arrow q in FIG. 1. The surface temperature of the heating roller 36 is maintained at a predetermined temperature by control of a not-shown temperature controller. In fixing portion 24, the toner image on recording sheet 13 is molten by heat from heating roller 36, and simultaneously, the toner image molten on the recording sheet 13 is pressed at the portion where heating roller 36 is in pressure contact with pressure roller 37. The toner image is thus fixed on recording sheet 13.

The recording sheet 13 with the toner image fixed thereon is transported in the direction of arrow n in FIG. 1 by paper transport rollers 20 and 21 and paper transport rollers 22 and 23 to be delivered to the outside of image formation apparatus 10.

Herein, after the development of the surface of photoreceptor drum 101 by development roller 104, the toner which is not used in the development and remains on the surface of development roller 104 is fed to the contact portion between development roller 104 and supply roller 106 along with the rotation of development roller 104. The toner is then collected by supply roller 106 and is fed downstream of the rotation direction of supply roller 106.

The collected toner is mixed with toner newly supplied from toner cartridge 120 and is fed to development roller 104. The development process is then repeatedly performed.

In some cases, a small amount of toner not transferred remains on the surface of photoreceptor drum 101 which has passed transfer roller 12.

Toner remaining on the surface of photoreceptor drum 101 described above is removed by cleaning blade 105. As illustrated in FIG. 2, cleaning blade 105 is extended in parallel to the rotation axis of photoreceptor drum 101. The proximal end is attached and fixed to a rigid supporting substrate so that the distal end (the end opposite to the proximal end) of cleaning blade 105 is in contact with the surface of photoreceptor drum 101. When photoreceptor drum 101 rotates about the rotation axis in the direction of arrow r and the cleaning blade 105 is brought into contact with the circumferential surface of photoreceptor drum 101, the toner remaining on the surface of photoreceptor drum 101 is removed by cleaning blade 105. The cleaned photoreceptor drum 101 rotates and is repeatedly used.

(A-2-2) Application Voltage and Time in Printing and Cleaning Modes

Next, a description is given of the operation of the cleaning mode. Herein, the cleaning mode refers to an operation mode in which extraneous matter that adheres to the surface of charge roller 102 which comes into contact with photoreceptor drum 101 in the printing mode and the like is removed from charge roller 102 at a predetermined time other than a time for the printing mode.

The cleaning mode is implemented by applying predetermined voltages, different from those used in the printing mode, to the respective constituent members at predetermined times. The polarity of extraneous matter that has adhered to the surface of charge roller 102 is opposite to the polarity of the voltage applied to charge roller 102 in the printing mode. The following description is given by representing the extraneous matter adhered to the surface of charge roller 102 as oppositely-charged extraneous matter.

The cleaning mode is provided because of the following reason. In the printing mode, the residue which has not been removed by cleaning blade 105 sometimes adheres to charge roller 102 provided downstream of the rotation direction of photoreceptor drum. 101, causing a charge failure. Accordingly, the cleaning mode is provided to remove the extraneous matter adhered to charge roller 102.

In the cleaning mode, recording sheets 13 are not transported, unlike in the printing mode. The direction of rotation of each roller in the cleaning mode is the same as that in the development and transfer processes, but the biases applied to the constituent members (LED head 15, charge roller 102, development roller 104, transfer roller 12, and motor 501), the times to apply the biases, and the like in the cleaning mode are different from those in the printing mode.

Figure 4:
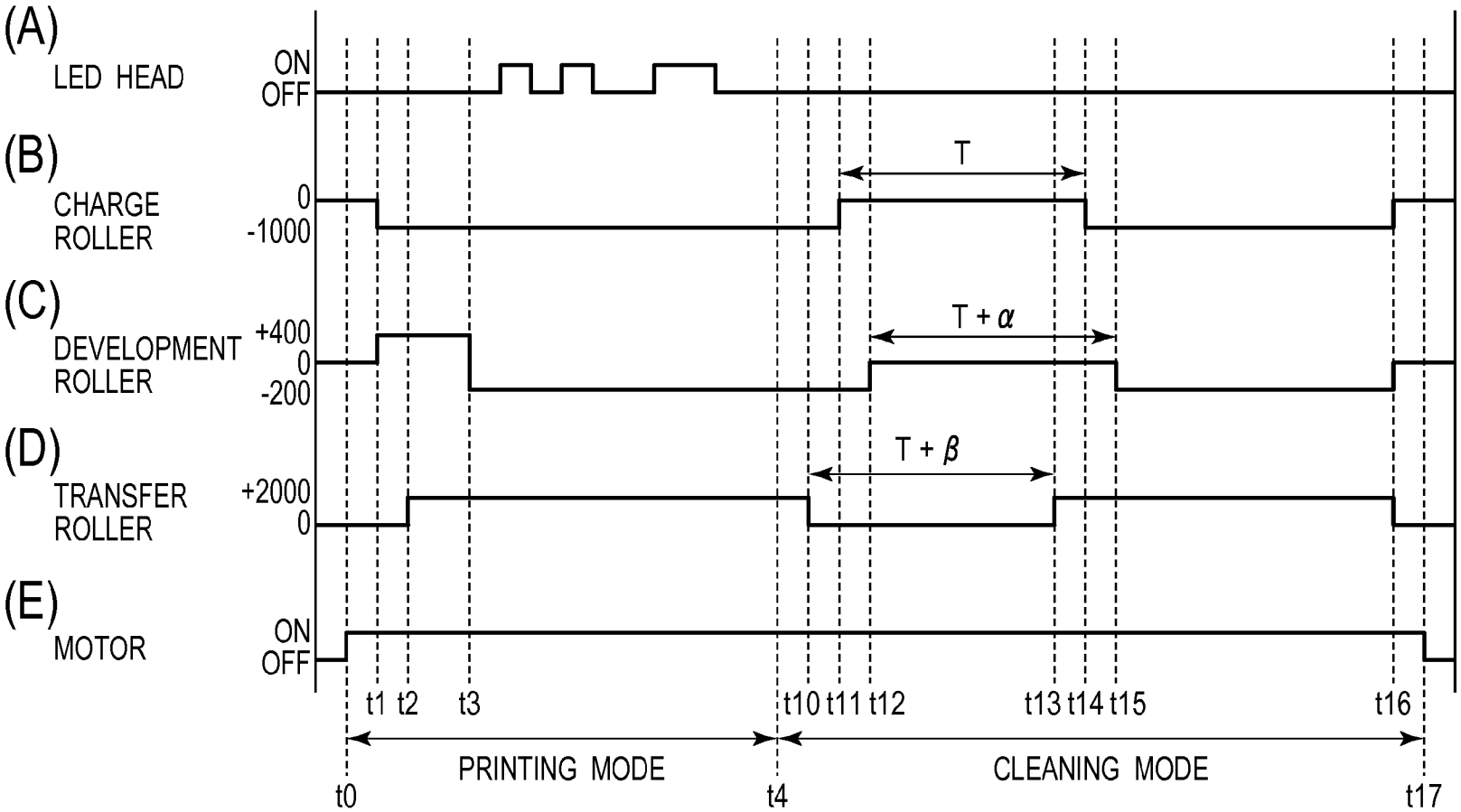
FIG. 4 is a time chart illustrating the application of a bias to each constituent member at a printing mode and a cleaning mode in the image formation apparatus according to the first embodiment.

FIG. 4 is a time chart showing the application of biases to the individual constituent members in the printing and cleaning modes of image formation apparatus 10 according to the first embodiment.

First, a description is given of the values of the biases applied to the constituent members (LED head 15, charge roller 102, development roller 104, transfer roller 12, and motor 501) and the times to apply the biases in the printing mode.

In the process of executing printing, controller 551 turns motor 501 on to start the printing mode at time t0. Photoreceptor drum 101, charge roller 102, development roller 104, supply roller 106, and transfer roller 12 are rotationally driven by motor 501 as the driving unit.

At time t1, charge roller power supply controller 502 is instructed by controller 551 to switch charge roller voltage power supply 522 from 0 V to −1000 V for charging the surface of photoreceptor drum 101, and development roller power supply controller 503 is instructed by controller 551 to switch development roller voltage power supply 523 from 0 V to +400 V.

At time t2, transfer roller power supply controller 505 is instructed by controller 551 to switch transfer roller voltage power supply 525 from 0 V to +2000 V.

At time t3, in order to pass toner from supply roller 106 to development roller 104, development roller power supply controller 503 is instructed by controller 551 to switch development roller voltage power supply 523 from +400 V to −200 V, and supply roller power supply controller 504 is instructed by controller 551 to switch supply roller voltage power supply 524 to −300 V.

Printing is executed from time t3 to time t4. To be specific, LED head controller 507 is instructed by controller 551 to cause LED head 15 to perform selective exposure based on acquired print data for writing an electrostatic latent image on the surface of photoreceptor drum 101. The portion of the surface of photoreceptor drum 101 where the electrostatic latent image is written (that is, an exposed portion) therefore has a surface potential closer to 0 V than to the surface potential of the not-exposed portion. The thin layer of toner formed on the surface of development roller 104 is transferred to the electrostatic latent image on the surface of photoreceptor drum 101 and is developed on the surface of photoreceptor drum 101 as a toner image. The toner image is transferred to recording sheet 13 by transfer roller 12, and the printing ends at the time t4.

Next, the operation in the cleaning mode is described.

In the cleaning mode, transfer roller power supply controller 505 is instructed by controller 551 to switch transfer roller voltage power supply 525 to 0 V at time t3.

A surface region of photoreceptor drum 101 is charged by charge roller 102 at a surface potential of −500 V before the surface region comes into contact with transfer roller 12. The surface potential of the charged surface region of photoreceptor drum 101 after the surface region passes transfer roller 12 is lowered to about −300 V because development roller 104 and transfer roller 12 are at 0 V.

After coming into contact with transfer roller 12, the surface region of the photoreceptor drum 101 comes into contact with the cleaning blade 105. At this time, the surface potential of the photoreceptor drum 101 does not change because cleaning blade 105 is an insulator and does not allow electric current to flow therethrough. Photoreceptor drum 101 further rotates, and the surface region of photoreceptor drum 101 comes into contact with charge roller 102 at time t11.

At time t11, charge roller power supply controller 502 is instructed by controller 551 to switch the output of charge roller voltage power supply 522 from −1000 V to 0 V. As a result, the extraneous matter adhered to charge roller 102 (extraneous matter having a polarity opposite to that of charge roller 102 at printing) is subjected to a Coulomb force from the surface of charge roller 102 charged at 0 V toward photoreceptor drum 101 negatively charged, and adheres to the surface of photoreceptor drum 101.

Herein, application time T for which the voltage of 0 V is applied to charge roller 102 needs to be equal to the time taken for charge roller 102 to rotate at least 360 degrees (the time period taken for one revolution of charge roller 102) in order to pass the oppositely-charged extraneous matter to photoreceptor drum 101.

When a lot of oppositely-charged extraneous matter adheres to charge roller 102, application time T for which 0 V is applied to charge roller 102 may be increased to a time period taken for two or three revolutions of charge roller 102. On the other hand, transfer roller voltage power supply 525 applies 0 V to transfer roller 12 during time (T+β). Accordingly, transfer roller voltage power supply 525 which is applying 0 V to transfer roller 12 needs to start applying a positive voltage before the surface region of photoreceptor drum 101, which comes into contact with charge roller 102 at time t11, comes into contact with transfer roller 102. Application time T is therefore limited by the circumferential length of photoreceptor drum 101.

The surface region of photoreceptor drum 101 with the oppositely-charged extraneous matter adhering thereto rotates in the direction of arrow r and then comes into contact with development roller 104.

Controller 503 switches the output of development roller power supply 523 from −200 V to 0 V at time t12. The oppositely-charged extraneous matter on photoreceptor drum 101 is thereby subjected to a Coulomb force toward photoreceptor drum 101 and remains adhered to photoreceptor drum 101.

After time (T+β) from time t10, transfer roller power supply controller 505 switches the output voltage of transfer roller power supply 525 from 0 V to a positive voltage at time t13. Herein, the value of β is a margin allowing the region of photoreceptor drum 101 having passed charge roller 102 while charge roller 102 is subjected to 0 V by charge roller power supply 522, to surely be equal to the region of photoreceptor drum 101 passing transfer roller 12 while transfer roller 12 is subjected to 0 V by transfer roller power supply 525.

After time T from time t11, charge roller power supply controller 502 switches the output voltage of charge roller power supply 522 from 0 V to −1000 V at time t14. During the time T, charge roller 102 rotates at least 360 degrees.

At time t15 after time (T+α) from the time t12, development roller controller 503 switches the output voltage of development roller power supply 523 from 0 V to −200 V. Herein, the value of a is a margin allowing development roller power supply 523 to surely apply 0 V to development roller 104, while the region of photoreceptor drum 101 that has passed charge roller 102 during application of 0 V to charge roller 102 by charge roller power supply 522 passes the contact portion with development roller 104.

The oppositely-charged extraneous matter on photoreceptor drum 101 having passed development roller 104 comes into contact with transfer roller 12 as photoreceptor drum 101 rotates in the direction of arrow r. At this time, transfer roller power supply 525 already applies a positive voltage to transfer roller 12. Accordingly, the oppositely-charged extraneous matter on photoreceptor drum 101 remains adhered to photoreceptor drum 101 while passing transfer roller 12.

As photoreceptor drum 101 further rotates in the direction of arrow r, the oppositely-charged extraneous matter on the surface of photoreceptor drum 101 comes into contact with cleaning blade 105 and is scraped off by cleaning blade 105.

After the entire region of the surface of photoreceptor drum 101, to which the oppositely-charged extraneous matter adheres, completely passes cleaning blade 105, controller 551 terminates the cleaning mode at time t16 and stops motor 501 at time t17 to stop the rotation of photoreceptor drum 101 and the rollers which come into contact with photoreceptor drum 101.

(A-2-3) Test Results at Printing and Cleaning Modes

Next, the aforementioned operations at the printing and cleaning modes are performed under the following conditions to confirm throughputs and the influences of a charge failure of charge roller 102 on the images.

(Test Result of Test 1)

Test 1 is performed using image formation apparatus 10 of FIG. 1 under the following conditions: the paper feed speed at printing=313 mm/sec and the inter-paper distance at a continuous printing=60 mm. The recording sheets used in Test 1 are OKI excellent white paper (paper size=A4, paper weight=80 g/m$^2$, made by Oki Data Corporation). The print pattern is a halftone print image (printing with an area ratio of 25% on the entire surface of the paper, except for 5 mm areas at the top, bottom, right, and left sides), and the sheets of paper are fed lengthways.

Figure 5:
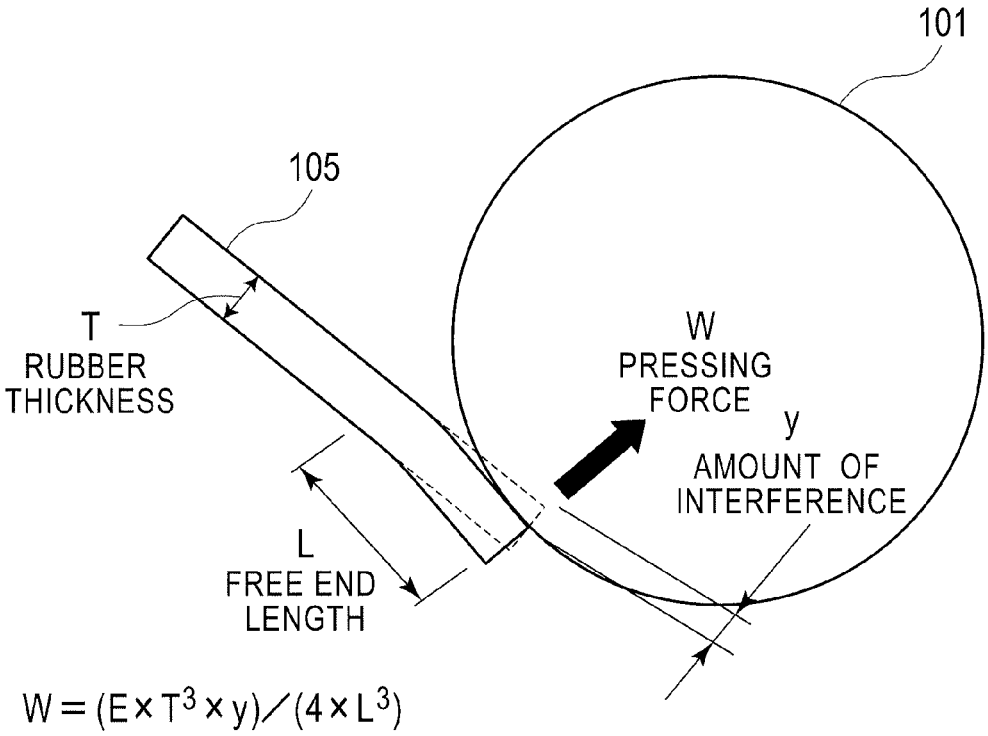
FIG. 5 is an explanatory diagram for explaining the manner in which a cleaning blade is attached according to the first embodiment.

FIG. 5 is a view for explaining the manner of how the cleaning blade 105 is attached according to the first embodiment.

As illustrated in FIG. 5, cleaning blade 105 used in the tests is made of a rubber material having a Young's modulus E of 70 kgf/cm$^2$, a rubber thickness T of 1.8 mm, and a free end length L of 7.7 mm. Amount y of interference of cleaning blade 105 with photoreceptor drum 101, that is, nip amount y or an overlapping depth y between cleaning blade 105 and photoreceptor drum 101 (see FIG. 5), is set to 0.45 mm. The pressing Force W with which cleaning blade 105 is pressed against photoreceptor drum 101 is therefore 10.1 gf/cm. Pressing force W is calculated based on the following Equation (1).

$$W=(E\times T^3\times y)/(4\times L^3) \quad (1)$$

FIG. 6 is a table showing the results of tests depending on environmental variations using image formation apparatus 10 according to the first embodiment. FIG. 6 summarizes the environmental variations of the tests, the number of print jobs, and the state of foreign substances adhered to charge roller 102.

In the test environment of Test 1, the temperature is 25° C., and the humidity is 50%. In this environment, the amount of water vapor is 11.53 g/m$^3$. The amount of water vapor is calculated based on Equations (2) and (3) below.

$$a=217\times e/(t+273.15)\times h/100 \quad (2)$$

$$e=6.11\times 10\hat{}(7.5t/(t+237.3)) \quad (3)$$

where a is the amount of water vapor (g/m$^3$); e, saturated water vapor pressure (hPa); t, environmental temperature (° C.); h, environmental humidity (%); and ^ represents exponentiation.

As for the number of prints, 500 recording sheets 13 are set in recording sheet cassette 16, and a print job of continuous printing of 500 sheets is performed ten times to print a total of 5000 sheets.

The cleaning mode is executed once each time 60 pages of paper are continuously printed.

After 5000 sheets of paper are printed, the surface potential of the surface of charge roller 102 is measured. Moreover, the surface of charge roller 102 is visually observed, and halftone print images are visually confirmed. The halftone print images (printing with an area ratio of 25% on the entire surface of paper except for 5 mm areas at the top, bottom, right, and left sides) are evaluated at three levels as the results of the visual confirmation. In FIG. 6, double circles, circles, and x-marks represent the best image state, the good image state, and the defective image state, respectively.

As shown in the test results of Test 1 of FIG. 6, very little extraneous matter is observed on the surface of charge roller 102. The surface potential, which is measured by a surface voltmeter (Model 344 by TREK INC.) with the metallic shaft of charge roller 102 set to GND and no voltage applied to charge roller 102, is +1 V. As a result of print visual observation, the halftone image is uniformly printed, and no image defects are observed.

(Test Result of Test 2)

In Test 2, a paper feeding test is performed without performing the cleaning mode under the same conditions as those of Test 1. The other conditions are the same as those of Test 1.

In the test results of Test 2, white extraneous matter is observed on the surface of charge roller 102. The surface potential is +20 V, that is, the surface of charge roller 102 is positively charged. An analysis by an FTIR (a Fourier transform infrared spectroscopy) shows that the extraneous matter on the surface of charge roller 102 includes melamine fine particles contained in the toner's external additives and the toner base material does not adhere to charge roller 102.

Moreover, in the result of print visual observation, image defects are observed, and white streaks of paper appear in the image to give an uneven density.

(Test Result of Test 3)

Test 3 is performed with the temperature and humidity set to 25° C. and 25%, respectively. The amount of water vapor is 5.77 g/m$^3$. The other conditions are the same as those of Test 1.

In the test result of Test 3, very little white extraneous matter is observed on the surface of charge roller 102. The surface potential is +2 V. The result of a print visual observation is that the halftone image is evenly printed, and no image defects are observed.

(Test Result of Test 4)

Test 4 is performed with the temperature and humidity set to 25° C. and 60%, respectively. The amount of water vapor is 13.84 g/m$^3$. The other conditions are the same as those in Test 1.

The test result of Test 4 is that very little white extraneous matter is observed on the surface of charge roller 102. The surface potential is +1 V. The result of a print visual observation is that the halftone image is evenly printed, and no image defects are observed.

(Test Result of Test 5)

Test 5 is performed with the temperature and humidity set to 25° C. and 20%, respectively. The amount of water vapor is 4.61 g/m$^3$. The other conditions are the same as those in Test 1.

The test result of Test 5 is that a small amount of white extraneous matter is observed on the surface of charge roller 102. The surface potential is +10 V. The result of a print visual observation is that no defect is observed in the halftone image.

(Test Result of Test 6)

Test 6 is performed with the temperature and humidity set to 25° C. and 65%, respectively. The amount of water vapor is 15.0 g/m$^3$. The other conditions are the same as those in Test 1.

The test result of Test 6 is that a small amount of white extraneous matter is observed on the surface of charge roller 102. The surface potential is +8 V. The result of a print visual observation is that no image defects are observed in the halftone image.

(Test Result of Test 7)

Test 7 is performed with the temperature and humidity set to 25° C. and 70%, respectively. The amount of water vapor is 16.14 g/m$^3$. The other conditions are the same as those in Test 1.

The test result of Test 7 is that a lot of white extraneous matter is observed on the surface of charge roller 102. The surface potential is +12 V. The result of a print visual observation is that a white streak of paper is observed in the halftone image, and uneven density is observed. The image is evaluated as a defective image.

(Test Result of Test 8)

Test 8 is performed under the same environmental conditions as those of Test 7. The execution frequency of the cleaning mode in Test 8 is once for a continuous printing of 12 pages instead of once for a continuous printing of 60 pages.

In the test result of Test 8, the surface potential is +2 V. The result of a print visual observation is that no image defects are observed in the halftone image.

(Test Results of Tests 9 and 10)

Tests 9 and 10 are performed with the temperature and humidity set to 30° C. and 20%, respectively. The amount of water vapor is 6.08 g/m$^3$.

In Test 9, the cleaning mode is executed once each time 60 pages are continuously printed. In Test 10, the cleaning mode is executed once each time 12 pages are continuously printed.

In the test result of Test 9, the surface potential is +18 V. The result of a print visual observation is that image defects are observed in the halftone image.

On the other hand, in the test result of Test 10, the surface potential is +3 V. The result of a print visual observation is that no image defects are observed in the halftone image.

(Test Results of Tests 11 and 12)

Tests 11 and 12 are performed with the temperature and humidity set to 30° C. and 50%, respectively. The amount of water vapor is 15.19 g/m$^3$.

In Test 11, the cleaning mode is executed once each time 60 pages are continuously printed. In Test 12, the cleaning mode is executed once each time 12 pages are continuously printed.

In the test result of Test 11, the surface potential is +18 V. The result of a print visual observation is that image defects are observed in the halftone image.

On the other hand, in the test result of Test 12, the surface potential is +3 V. The result of a print visual observation is that no image defects are observed in the halftone image.

(Test Results of Tests 13 and 14)

Tests 13 and 14 are performed with the temperature and humidity set to 30° C. and 80%, respectively. The amount of water vapor is 24.30 g/m$^3$.

In Test 13, the cleaning mode is executed once each time 60 pages are continuously printed. In Test 14, the cleaning mode is executed once each time 12 pages are continuously printed.

In the test result of Test 13, the surface potential is +18 V. The result of a print visual observation is that image defects are observed in the halftone image.

On the other hand, in the test result of Test 14, the surface potential is +3 V. The result of a print visual observation is that no image defects are observed in the halftone image.

(Test Results of Tests 15 and 16)

Tests 15 and 16 are performed with the temperature and humidity set to 10° C. and 20%, respectively. The amount of water vapor is 1.88 g/m$^3$.

In Test 15, the cleaning mode is executed once each time 60 pages are continuously printed. In Test 16, the cleaning mode is executed once each time 12 pages are continuously printed.

In the test result of Test 15, the surface potential is +15 V. The result of a print visual observation is that image defects are observed in the halftone image.

On the other hand, in the test result of Test 16, the surface potential is +2 V. The result of a print visual observation is that no image defects are observed in the halftone image.

The aforementioned test results of Tests 1 to 16 reveal that in high-temperature environments (where the environmental temperature is not lower than 30° C.), image defects start to occur when more than about 300 pages are continuously printed irrespectively of the influence of the amount of water vapor, even when the cleaning mode is executed once each time 60 pages are printed. The occurrence of image defects can be prevented by executing the cleaning mode once each time 12 pages are continuously printed.

In low-humidity environments (where the environmental temperature is lower than 30° C. and the amount of water vapor is 4.6 to 15.0 g/m$^3$, both inclusive), no image defect occurs, even when the cleaning mode is executed once each time 60 pages are continuously printed. In the case where the environmental temperature and the amount of water vapor are out of the above-described ranges, no image defect occurs even when the cleaning mode is executed once each time 12 pages are continuously printed.

(Test Result of Test 17)

In Test 17, the cleaning mode is executed once each time 12 pages are continuously printed, with the external additives adhered to the surface of charge roller 102 under the same conditions as those of Test 9.

The result of a print visual observation of Test 17 is that image defects disappear when about 240 pages are continuously printed. An observation of the surface of charge roller 102 shows that the extraneous matter is removed from the surface of charge roller 102. Accordingly, even when a continuous printing is started with the external additives adhered to the surface of charge roller 102, the effect of removing the external additives from the surface of charge roller 102 can be confirmed by increasing the execution frequency of the cleaning mode.

In Test 17, the surface potential of charge roller 102 is not higher than +10 V, with the external additives adhering thereto when no image defect occurs.

Next, an evaluation is performed for printed images obtained by changing the pressing force W of the cleaning blade 105 against photoreceptor drum 101 and starting the cleaning mode with the external additives adhered to the surface of charge roller 102.

Herein, pressing force W is changed by changing the amount y of interference (the nip amount y). The other conditions are the same as those of Test 3.

(Test Results of Tests 18 to 20)

In Test 18, the amount y of interference is set to 1.30 mm, and pressing force W is set to 29.1 gf/cm. In Test 18, the surface potential of charge roller 102 is +2 V, and no image defects are observed.

In Test 19, the amount y of interference is set to 1.40 mm, and pressing force W is set to 31.3 gf/cm. The cleaning blade 105 is raised up during the continuous printing, and Test 19 halts. This reveals that pressing force W needs to be not more than 29.1 gf/cm.

In Test 20, the amount y of interference is set to 0.42 mm, and pressing force W is set to 8.9 gf/cm. In Test 20, extraneous matter is observed on the surface of charge roller 102. The result of a print visual observation is that the occurrence of image defects is prevented when the cleaning mode is executed. However, extraneous matter immediately adheres to the surface of charge roller 102 again, and image defects continue to occur. The image is therefore evaluated as a defective image.

From the test results of Tests 18 to 20, pressing force W needs to be not less than 10.1 gf/cm and not more than 29.1 gf/cm.

As described above, it is possible to implement an efficient printing with a good image quality by applying the frequency of the cleaning mode in accordance with the environmental conditions.

(A-2-4) Operation of Cleaning Mode

Next, a description is given of the operation processing of image formation apparatus 10 according to the first embodiment in detail with reference to the drawings.

Figure 7:
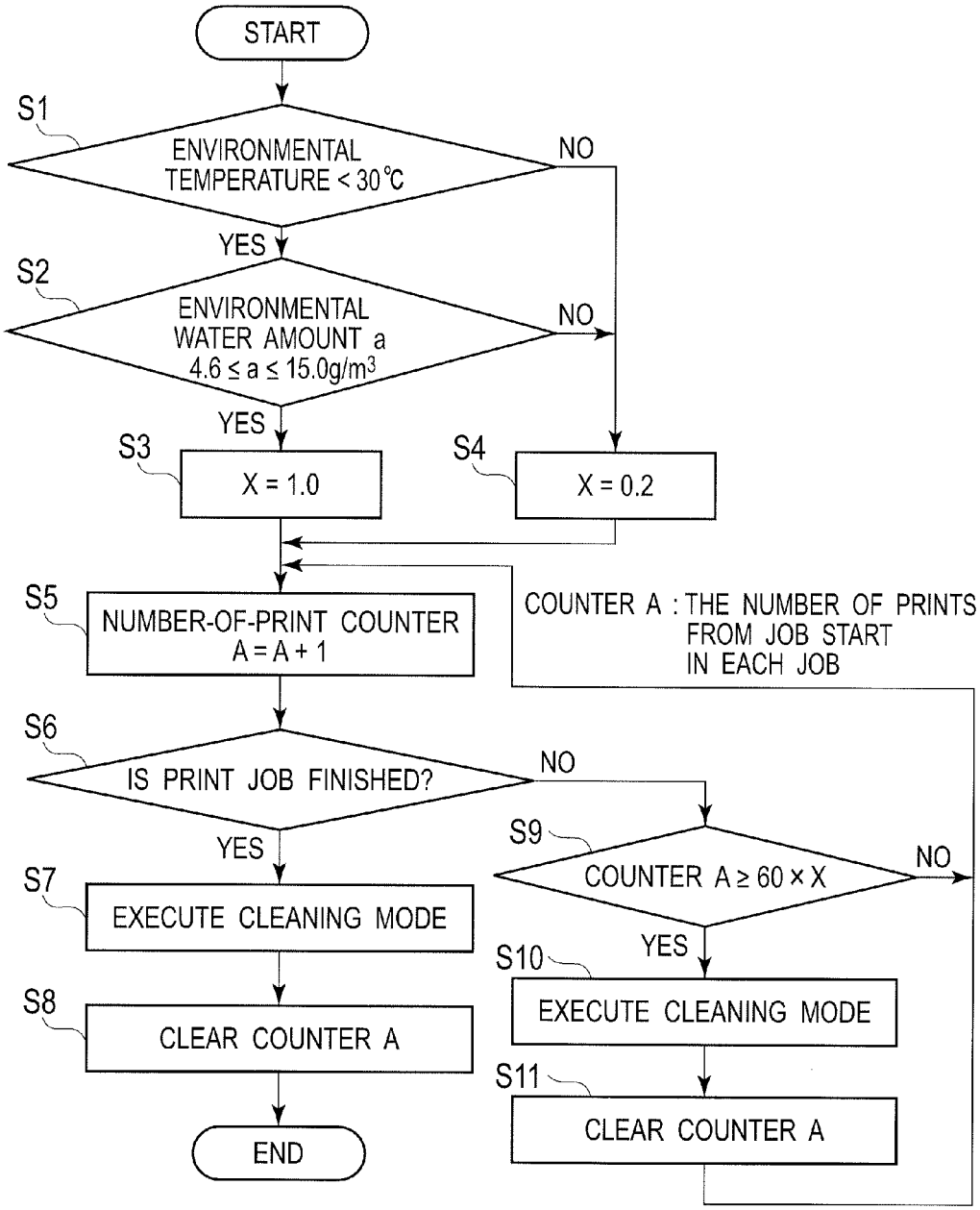
FIG. 7 is an operation flowchart in the case of changing the execution frequency of the cleaning mode in accordance with the environmental conditions in the image formation apparatus according to the first embodiment.

FIG. 7 is an operation flowchart of image formation apparatus 10 according to the first embodiment in the case of changing the execution frequency of the cleaning mode in accordance with the environmental conditions.

In FIG. 7, when printing is started, controller 551 detects the environmental temperature (S1). Image formation apparatus 10 is provided with sensor portion 508 including temperature sensor 509, humidity sensor 510, and the like. Controller 551 detects the environmental temperature based on information received from temperature sensor 509.

When the environmental temperature is lower than 30° C. in S1, the process goes to S2, and when the environmental temperature is not lower than 30° C. in S1, the process goes to S4.

In S2, controller 551 detects the humidity based on the data from humidity sensor 510 and calculates the environmental water amount (water vapor amount) a in accordance with Equations (2) and (3). Controller 551 determines whether environmental water amount (water vapor amount) a is in a range of 4.6 $g/m^3 \leq a \leq 15.0$ $g/m^3$ (S2) and selects coefficient X in accordance with the value of environmental water amount a (S3, S4).

To be specific, when environmental water amount a is in the range of 4.6 $g/m^3 \leq a \leq 15.0$ $g/m^3$, coefficient X is set to 1.0 (S3). When environmental water amount a is not in the range of 4.6 $g/m^3 \leq a \leq 15.0$ $g/m^3$, coefficient X is set to 0.2 to increase the execution frequency of the cleaning mode (S4).

As described above, the value of coefficient X is determined based on the environmental temperature and humidity by the processing of S1 and S2.

Controller 551 then counts the number of prints (counter value A) (S5). Counter value A is the number of pages printed from the start of each print job in the print job.

In S6, controller 551 determines whether the print job is ongoing or finished (S6). When the print job is not finished yet, the process goes to S9.

In S9, the execution frequency of the cleaning mode is configured to be basically executed once each time 60 pages are continuously printed. Controller 551 compares counter value A of the number of prints with "60×X" indicating the execution frequency of the cleaning mode (S9). When counter value A>=60×X, the process goes to S10, and controller 551 executes the cleaning mode (S10). When counter value A<60×X, the process goes to S5, and controller 551 repeats the process.

In S9, controller 551 determines the execution frequency of the cleaning mode based on counter value A of the number of prints by using coefficient X determined by the environmental conditions.

To be specific, coefficient X is set to 1.0 in the environmental conditions where the execution frequency of the cleaning mode does not need to be high. Accordingly, the cleaning mode is executed once each time that 60 pages are printed. On the other hand, coefficient X is set to 0.2 in the environmental conditions where the execution frequency of the cleaning mode needs to be high. The cleaning mode is therefore executed once each time that 12 pages are printed.

When the cleaning mode is executed in S10, counter value A is cleared (S11), and the process returns to S5. Counter value A is counted starting from 1.

When the print job is finished in S6, the cleaning mode is executed (S7), the counter value A is cleared (S8), and the process is terminated.

By the operation processing of FIG. 7, the execution frequency of the cleaning mode can be increased or reduced based on the environment where image formation apparatus 10 is placed. The execution frequency of the cleaning mode can be determined by an initial setting, and it is possible to prevent degradation of throughput in the normal environment.

FIG. 8 is an operation flowchart of image formation apparatus 10 according to the first embodiment in the case of changing the execution frequency of the cleaning mode in accordance with the environmental conditions under which image formation apparatus 10 is placed and whether comparatively short print jobs are successively performed.

In FIG. 8, when printing is started, controller 551 detects the environmental temperature (S51).

When the detected environmental temperature is lower than 30° C. in S51, the process goes to S52, and when the detected environmental temperature is not lower than 30° C. in S51, the process goes to S54.

In S52, controller 551 detects the humidity and calculates environmental water amount (water vapor amount) a in accordance with Equations (2) and (3). Controller 551 determines whether environmental water amount (water vapor amount) a is in a range of 4.6 $g/m^3 \leq a \leq 15.0$ $g/m^3$ (S52) and selects coefficient X in accordance with the value of environmental water amount a (S53, S54).

To be specific, when environmental water amount a is in the range of 4.6 $g/m^3 \leq a \leq 15.0$ $g/m^3$, coefficient X is set to 1.0 (S53). When environmental water amount a is not in the range of 4.6 $g/m^3 \leq a \leq 15.0$ $g/m^3$, coefficient X is set to 0.2 to increase the execution frequency of the cleaning mode (S54).

As described above, the value of coefficient X is determined based on the environmental temperature and humidity by the processing of S51 and S52.

Controller 551 then counts counter values A, B, and C in S55.

Herein, counter value A is the number of pages printed from the start of the current print job in the current print job. Counter value B is the cumulative number of pages continuously printed. Counter value C is a number of jobs to continuously print not more than 12 pages (jobs whose number of pages printed is comparatively small).

Coefficient F is determined by the size of the cumulative number of pages continuously printed in S56. In S56, controller 551 determines whether count value B indicating the cumulative number of pages continuously printed is more than 200.

When counter value B is not more than 200, controller 551 sets coefficient F to 1.0 (S57). When counter value B is more than 200, controller 551 sets coefficient F to X (S58)

Herein, coefficient F is set to X. When the environmental conditions under which image formation apparatus 10 is placed are normal conditions, X is selected to be 1.0 in S53. Coefficient F is therefore set to 1.0 in the normal environmental conditions even when counter value B is more than 200. X is selected to be 0.2 in S54 under environmental conditions where the execution frequency of the cleaning mode needs to be increased. Accordingly, X is selected to be 0.2 in S58 under environmental conditions where the execution frequency of the cleaning mode needs to be increased.

In S59, controller 551 determines whether the print job is finished or not (S59). When the print job is not finished, the process goes to S64.

In S64, the cleaning mode is configured to be basically executed once each time 60 pages are continuously printed. Controller 551 compares counter value A of the number of prints with "60×F" indicating the execution frequency of the cleaning mode (S64). When counter value A>=60×F, the process goes to S65, and controller 551 executes the cleaning mode (S65). When counter value A<60×F, the process goes to S55, and controller 551 repeats the process.

In S64, controller 551 determines the execution frequency of the cleaning mode based on counter value A of the number of prints by using coefficient F determined by the environmental conditions.

To be specific, when the environmental conditions are the normal environmental conditions and when the total number of pages continuously printed is not more than 200, the execution frequency of the cleaning mode does not need to be high, and coefficient F is set to 1.0. Accordingly, the cleaning mode is executed once each time 60 pages are continuously printed.

On the other hand, when the environmental conditions are the environmental conditions where the execution frequency of the cleaning mode needs to be high and the cumulative number of pages continuously printed is more than 200, the execution frequency of the cleaning mode needs to be high and coefficient X is set to 0.2. Accordingly, the cleaning mode is executed each time 12 pages are continuously printed.

When the cleaning mode is executed in S65, counter value A is cleared (S66), and the process returns to S55. Counter value A is counted starting from 1.

When the print job is finished in S59, controller 551 goes to S60.

In S60, S61, and S63, the value of counter value C is changed in accordance with whether each print job is comparatively short or not.

First, controller 551 determines whether counter value A is more than 12, that is, whether the number of prints of the current print job is less than 12 or not (S61).

When counter value A is not more than 12, that is, when the current print job is comparatively small, controller 551 adds 1 to counter value C (S63).

When counter value A is more than 12, that is, when the number of prints of the current print job is comparatively large, controller 551 clears counter value C (S61).

When counter value C is not less than 50 (S67), that is, when the number of jobs to continuously print less than 12 pages is large, the counter value B is cleared (S68).

When counter value C is less than 50 (S67), counter value B is not cleared, and the execution frequency of the cleaning mode is thereby maintained high at the start of the next print job even when the cumulative number of pages continuously printed is not more than 200.

At the end, the cleaning mode is executed in S69, counter value A is cleared in S70, and the process is terminated.

Counter value A is cleared at the end of each print job or when the cleaning mode is executed. On the other hand, counter values B and C are cleared only in S68 and S61, respectively, and are not cleared at the end of each print job or when the cleaning mode is executed.

The information concerning the execution frequency of the cleaning mode is taken over by the next print job.

In FIG. 8, the execution frequency of the cleaning mode can be changed according to the environmental conditions and also can be changed according to the history of the execution frequency of the cleaning mode.

(A-2-5) Modification of Operation of Cleaning Mode

Next, with reference to the drawings, a description is given of a modification of the operation to change the execution frequency of the cleaning mode in accordance with the environmental conditions of image formation apparatus 10 which is described in FIGS. 7 and 8.

Figure 12:
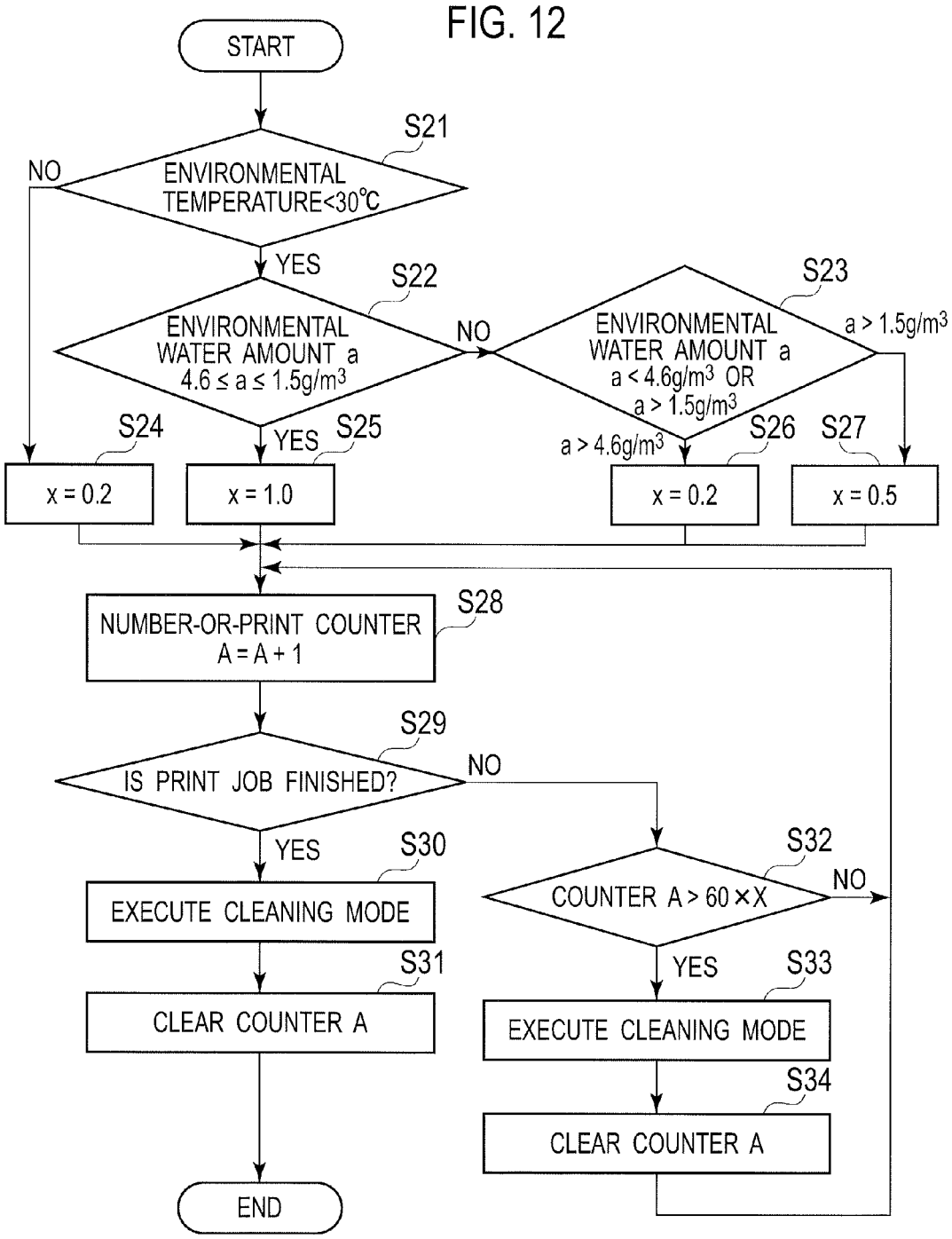
FIG. 12 is an operation flowchart in the case of changing the execution frequency of the cleaning mode in accordance with the environmental conditions in the image formation apparatus according to a modification.

FIG. 12 is a flowchart showing a modification of the operation to change the execution frequency of the cleaning mode in accordance with the environmental conditions shown in FIG. 7 as an example.

The flowchart shown in FIG. 12, byway of example, differs from the flowchart shown in FIG. 7, by way of example, in that steps S1 to S4 in FIG. 7 are replaced with the steps of S21 to S27 of FIG. 12.

In the flowchart shown in FIG. 12, by way of example, the execution frequency of the cleaning mode can be adequately changed even when environmental water amount a is not in the range of 4.6 $g/m^3 \leq a \leq 15.0$ $g/m^3$, that is, when image formation apparatus 10 is placed in the HH environment or LL environment.

To be specific, coefficient X is configured to be set so that the execution frequency of the cleaning mode is higher when image formation apparatus 10 is placed in the HH environment or LL environment than that in the normal-temperature and normal-humidity environment.

In FIG. 12, when printing is started, controller 551 detects the environmental temperature based on the information given from temperature sensor 509 and humidity sensor 510 in a similar manner to S1 of FIG. 7 (S21).

In S21, when the environmental temperature is lower than 30° C. in S21, the process goes to S22, and when the environmental temperature is not lower than 30° C. in S21, the process goes to S24.

In S24, controller 551 sets coefficient X to 1.0 (S24).

In S22, controller 551 detects the humidity based on data from humidity sensor 510 and calculates environmental water amount (water vapor amount) a in accordance with Equations (2) and (3). Controller 551 determines whether environmental water amount (water vapor amount) a is in a range of 4.6 $g/m^3 \leq a \leq 15.0$ $g/m^3$ (S22).

When environmental water amount a is in the range of 4.6 $g/m^3 \leq a \leq 15.0$ $g/m^3$ in S25, controller 551 sets coefficient X to 1.0 (S25).

In S25, environmental water amount a is in the range of 4.6 $g/m^3 \leq a \leq 15.0$ $g/m^3$, that is, image formation apparatus 10 is placed in the normal-temperature and normal-humidity environment. In this case, the execution frequency of the cleaning mode is determined by setting coefficient X in a similar manner to S3 of FIG. 7.

In S23, controller 551 determines whether the environmental water amount $a<4.6$ g/m$^3$ or whether the environmental water amount $a>15.0$ g/m$^3$.

When environmental water amount a is not in the range of 4.6 g/m$^3 \leq a \leq 15.0$ g/m$^3$ and is in the range of $a<4.6$ g/m$^3$, that is, image formation apparatus 10 is placed in the LL environment, controller 551 sets coefficient X to 0.2 (S26).

When environmental water amount a is not in the range of 4.6 g/m$^3 \leq a \leq 15.0$ g/m$^3$ and is in the range of 15.0 g/m$^3<a$, that is, image formation apparatus 10 is placed in the HH environment, controller 551 sets coefficient X to 0.5 (S27).

Herein, in S2 to S4 of FIG. 7, the execution frequency of the cleaning mode is set higher when environmental water amount a is not in the range of 4.6 g/m$^3 \leq a \leq 15.0$ g/m$^3$, that is, image formation apparatus 10 is placed in the HH environment or LL environment than that when image formation apparatus 10 is placed in the normal-temperature and normal-humidity environment. Moreover, the coefficient X is set to the same value when image formation apparatus 10 is placed in the HH environment as that when image formation apparatus 10 is placed in the LL environment. In other words, in the example shown in FIG. 7, the execution frequency of the cleaning mode when image formation apparatus 10 is placed in the HH environment is the same as that when image formation apparatus 10 is placed in the LL environment.

However, in the LL environment, the electric charged amount of the developer is higher than that in the high-temperature and high-humidity environment, and the external additives are more likely to adhere to the development roller. It is therefore preferable that the execution frequency of the cleaning mode is set higher in the LL environment than that in the HH environment.

As shown in FIG. 12, for example, when image formation apparatus 10 is not placed in the normal-temperature and normal humidity environment, where the environmental water amount a is in the range of 4.6 g/m$^3 \leq a \leq 15.0$ g/m$^3$, in S22, that is, in the HH environment or LL environment, the case where image formation apparatus 10 is placed in the HH environment and the case where image formation apparatus 10 is placed in the LL environment are discriminated from each other in S23. Controller 551 may be configured to determine the value of coefficient X in accordance with the result of the discrimination in S26 or S27.

Controller 551 sets the coefficient X to a smaller value in the LL environment than that in the HH environment by setting coefficient X to 0.2 in S26 and setting coefficient X to 0.5 in S27. The execution frequency of the cleaning mode in the LL environment can be set higher than the execution frequency of the cleaning mode in the HH environment.

Herein, the execution frequency of the cleaning mode is higher both in the LL environment and HH environment than that in the normal-temperature and normal-humidity environment. To be specific, while the cleaning mode is executed each time 60 pages are continuously printed in the normal-temperature and normal-humidity environment, for example, the cleaning mode is executed each time 30 pages are continuously printed in the LL environment, for example, and the cleaning mode is executed each time 12 pages are continuously printed in the HH environment, for example.

The processing of S28 to S34 in FIG. 12 is the same as, or corresponds to, the processing of S5 to S11 in FIG. 7, and the detailed description thereof is omitted.

The flowchart of FIG. 12 is described as a modification of the flowchart of FIG. 7 above.

However, the technical idea intended by the processing of S28 to S34 of FIG. 12 is applicable to that shown in FIG. 8. In other words, the processing of S51 to S54 of the flowchart of FIG. 8 may be replaced with the processing of S21 to S27 of the flowchart of FIG. 12.

Moreover, the technical idea intended by the processing of S28 to S34 of FIG. 12 is applicable to the processing of a second embodiment.

(A-3) Effects of the First Embodiment

As described above, according to the first embodiment, the execution frequency of the cleaning mode can be set to an optimal value based on the environmental conditions (printing conditions) in which the image formation apparatus is placed and the history of the execution frequency of the cleaning mode. Accordingly, it is possible to prevent the external additives from adhering to the surface of the charge roller and prevent the occurrence of image defects while reducing the degradation of the throughput.

(B) Second Embodiment

Next, a description is given of a second embodiment of the image formation apparatus of the invention in detail with reference to the drawings.

The rubber material of the cleaning blade changes in its physical properties depending on the environment. For example, the rubber material is more likely to be hardened in the LL environment. When the rubber material of the cleaning blade is hardened, the ability thereof to scrape the toner on the photoreceptor drum off is degraded. Accordingly, toner slips past the blade, and much more extraneous matter (external additives) tends to adhere to the charge roller.

The external additives as the extraneous matter are therefore deposited on the surface of the charge roller more quickly in the LL environment than in the HH environment. Accordingly, the portion where external additives are deposited has a low density, and one or more white vertical streak(s) is more likely to appear in the prints.

If the execution frequency of the cleaning mode is always controlled and optimized to fit the LL environment, the cleaning mode is executed more than necessary in the HH environment, and thus the printing throughput is degraded.

In intermittent printing, in which a standby state is interposed during the continuous printing, the amount of toner scattered is smaller than that in the normal continuous printing, and the external additives are deposited on the surface of the charge roller more slowly than in the normal continuous printing.

Accordingly, if the same control as that in the normal continuous printing is performed in the intermittent printing, the cleaning mode is executed more than necessary, and the printing throughput is degraded.

In light of the aforementioned problem, the second embodiment is configured to execute the cleaning mode at an optimal frequency in accordance with whether or not image formation apparatus 10A is placed in the LL environment and whether the current job is an intermittent print job.

(B-1) Configuration of the Second Embodiment

Image formation apparatus 10A according to the second embodiment includes the same constituent members as, or corresponding to, those of image formation apparatus 10 of FIGS. 1 and 2 according to the first embodiment.

The second embodiment is therefore described also using FIGS. 1 and 2 according to the first embodiment.

(B-2) Operation of the Second Embodiment

Figure 9:
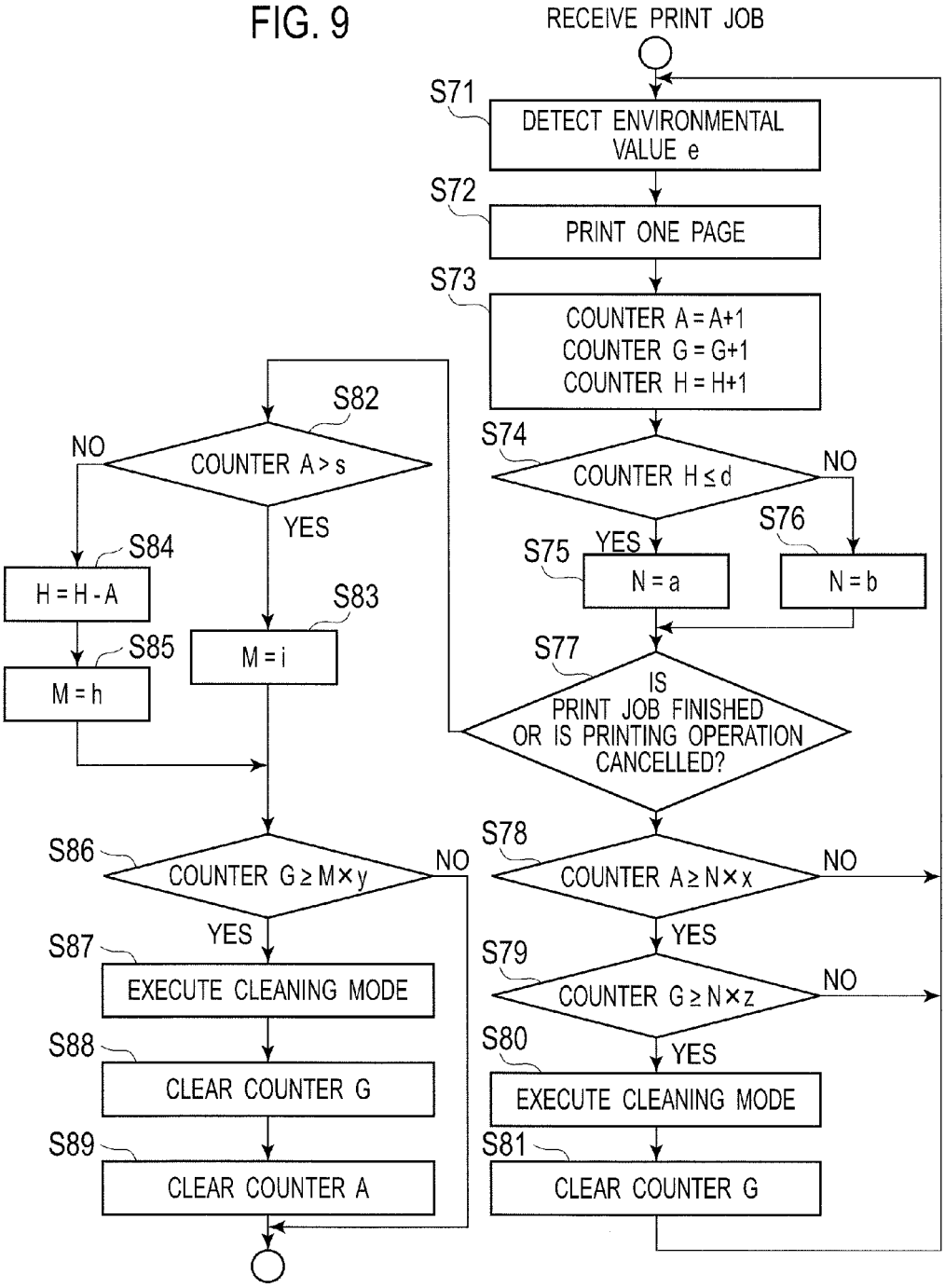
FIG. 9 is a flowchart illustrating the operation of the cleaning mode of an image formation apparatus according to a second embodiment.

FIG. 9 is a flowchart showing the operation of the cleaning mode in image formation apparatus 10A according to the second embodiment.

In FIG. 9, S71 to S81 form a flow of processing executed each time one page is printed and the steps are repeated in a loop until the current print job is finished or the printing operation is canceled in the middle. When the current print job is finished or the printing operation is canceled (S77), the operation of the cleaning mode goes to the processing of S82 to S89. When the processing of S82 to S89 is finished, the processing flow is then terminated.

In the case of intermittent printing, print data is received by controller 551 of image formation apparatus 10A as plural print jobs to print several pages each.

For example, in the case of the intermittent printing of 20 pages, four print jobs to print five pages each are received by controller 551. Accordingly, the operation flow of the intermittent printing goes to the route of S82 to S89 (described below) more times than that of a normal continuous printing.

In FIG. 9, when controller 551 receives a print job, printing is started. First, controller 551 detects environmental value e of sensor portion 508 in order to know the environmental value indicating the environmental conditions under which image formation apparatus 10 is placed (S71).

Herein, environmental value e is a value determined based on sensing data detected by temperature sensor 509 and humidity sensor 510.

FIG. 10 is an explanatory view for explaining environmental value e according to the second embodiment. In FIG. 10, the vertical axis gives ranges of temperature based on values read by temperature sensor 509, and the horizontal axis gives ranges of humidity based on values read by humidity sensor 510.

Environmental value e is a value evaluated at eight levels of 1 to 8. Environmental value e close to 8 represents the LL environment, and environmental value e close to 1 represents the HH environment. Environmental value e is evaluated at eight levels in the example shown in the second embodiment, but the invention is not limited to eight levels. Environmental value e may be also evaluated at multiple levels other than eight levels as long as the LL environment and HH environment can be discriminated from each other.

Controller 551 detects as environmental value e, a value at a position in FIG. 10 where the row of the temperature range including the temperature given from temperature sensor 509 intersect the column of the humidity range including the humidity given from humidity sensor 510.

Controller 551 performs the printing operation of one page (image formation operation) (S72). After the one page is printed, controller 551 controls and updates counter values A, G, and H below (S73).

Herein, counter value A represents the number of pages printed from the start of the current print job. Counter value G represents the number of pages printed after the end of the previous execution of the cleaning mode. Counter value H is the total number of pages printed after image formation apparatus 10A is powered on or is awoken from the sleep mode.

Counter value A is the number of pages printed from the start of the current print job and is cleared at the end of the print job (S79). Counter value G is the number of pages printed after the end of the previous cleaning mode. Counter value G is irrespective of print jobs and is cleared when the cleaning mode is executed. Counter value His the total number of pages printed after image formation apparatus 10A is powered on or is awoken from the sleep mode. Counter value H is irrespective of the print job and is cleared when image formation apparatus 10A is powered on or is awoken from the sleep mode.

In S74, controller 551 compares counter value H with parameter d (S74). When counter value H≤parameter d, the process goes to S75, and when counter value H>parameter d, the process goes to S76. In other words, controller 551 judges the determination conditions for changing the execution frequency of the cleaning mode based on the total number of pages printed.

FIG. 11 is an explanatory view for explaining various parameters according to the second embodiment. In FIG. 11, parameters x, y, z, a, b, h, i, d, and s are determined in accordance with the value of environmental value e.

Parameters x, y, and z are reference values of the execution frequency of the cleaning mode. For example, as shown in FIG. 11, when parameter x is 75, the cleaning mode is basically executed each time 75 pages are continuously printed. Parameters x, y, and z are changed in accordance with the value of environmental value e. To be specific, when environmental value e is smaller than a predetermined value, or when environmental value e is larger than another predetermined value, parameters x, y, and z are small values, and otherwise, parameters x, y, and z are large values.

In other words, parameters x, y, and z are larger when the temperature is between predetermined low and high temperatures (between 30° C. and 10° C.) and the humidity is between predetermined low and high humidities (between 25% and 60%), than when the temperature is below the predetermined low temperature and the humidity is below the predetermined low humidity or when the temperature is equal to or above the predetermined high temperature and the humidity is equal to or above the predetermined high humidity.

Parameters a, b, h, and i are determined in accordance with the printing environment and are multiplied by parameters x, y, and z to change the execution frequency of the cleaning mode.

Parameters a and b are determined in accordance with the value of counter value H representing the total number of pages printed after image formation apparatus 10A is powered on or is awoken from the sleep mode. Parameters a and b are assigned to cleaning mode execution frequency parameter N, described later.

Parameters h and i are determined in accordance with whether the current print job is an intermittent print job. To be specific, parameters h and i are determined in accordance with the value of the counter value A, which is the number of pages printed from the start of the current print job. Parameters h and i are assigned to cleaning-mode execution frequency parameter M, described later.

Parameter d is a threshold of the total number of pages printed after image formation apparatus 10A is powered on or is awoken from the sleep mode and is irrespective of the print job. Parameter d is used for comparison with counter value H in order to determine which one of parameters a and b is set as cleaning mode execution frequency parameter N. Parameter d is set to 200 in FIG. 11, for example, but is not limited thereto. Parameter d is set to 200 for the reason that extraneous matter tends to adhere to the surface of charge roller 102 after about 200 pages are continuously printed. The value of parameter d may therefore be properly set.

Parameter s is a threshold to determine whether the current job is an intermittent printing. Parameter s is used for comparison with counter value A in order to determine which one of parameters h and i is set as cleaning mode execution frequency parameter M. Parameter s is set to 10 in FIG. 11, for example, but is not limited thereto. Parameter s is set to 10 so that the print job is determined to be an intermittent print job when the number of pages printed in the print job is in the following cases. The value of parameter s may therefore be properly set.

Parameter d in S74 is a parameter depending on whether the total number of pages printed exceeds a predetermined threshold and is used to determine parameter N.

Parameters d, a, and b are parameters determined based on environmental value e in FIG. 11.

When counter value H is not larger than parameter d, cleaning mode execution frequency parameter N is set to a (S75). Herein, a>b as shown in FIG. 11. Accordingly, when counter value H, which is the total number of pages printed, exceeds parameter d, a control is made to reduce the execution frequency of the cleaning mode.

On the other hand, when counter value H exceeds parameter d, cleaning mode execution frequency parameter N is set to b (S76). Herein, a>b as shown in FIG. 11. Accordingly, when counter value H, which is the total number of pages printed, exceeds parameter d, a control is made to increase the execution frequency of the cleaning mode.

The aforementioned control is performed because, as the number of prints increases, the external additives of the toner are gradually deposited on charge roller 102 and the cleaning mode therefore needs to be executed earlier.

In S77, controller 551 determines whether the print job is finished or the printing operation is canceled (S77). When the printing operation is continued, the process goes to S78. On the other hand, when the print job is finished or the printing operation is cancelled, the process goes to S82.

In S78, controller 551 compares counter value A with "N×x". When counter value A>=N×x, the process goes to S79. When counter value A<N×x, the process returns to S71, and controller 551 repeats the processing. In S78, controller 551 determines whether to execute the cleaning mode. To be specific, controller 551 determines whether to execute the cleaning mode based on the number of pages printed until the first execution of the cleaning mode.

Herein, a third execution frequency value indicates a×x of N×x. A fourth execution frequency value indicates b×x of N×x. A fifth execution frequency value indicates b×x or a×x of N×x.

In S79, controller 551 compares counter value G with "N×z" (S79). When counter value G>=N×z, the process goes to S80. When counter value G<N×z, the process returns to S71, and controller 551 repeats the processing. In S79, controller 551 determines whether to execute the cleaning mode. In other words, controller 551 determines whether to execute the cleaning mode based on the number of pages printed until the second execution of the cleaning mode.

Whether to execute the first cleaning mode and whether to execute the second or subsequent cleaning mode are separately determined for the purpose of maximizing the printing throughput until the first execution of the cleaning mode.

The cleaning mode is executed in S80, and counter value B is then cleared in S81. The process then returns to S71, and counter value B is counted starting from 1 again.

When the print job is finished or the printing operation is canceled in S77, the process goes to S82.

In S82, controller 551 compares counter value A with parameter s to determine if the current job is an intermittent print job. When counter value A is larger than parameter s, the process goes to S83, and when counter value A is not larger than parameter s, the controller goes to S84.

To be specific, as shown in FIG. 11, parameter s is a threshold to determine whether the current job is the intermittent print job based on the number of pages printed in the current print job.

In the case of an intermittent printing, the print data is divided into print jobs to print several pages to be received, and counter value A, which is the number of pages printed from the start of the print job, is small. Accordingly, when counter value A≤s, controller 551 determines that the current print job is an intermittent print job. On the other hand, when counter value A>s, controller 551 determines that the current print job is not an intermittent print job.

In S84, controller 551 subtracts counter value A from counter value H, which indicates the total number of pages printed, and sets the result as a new value of counter value H (S84). In other words, S84 is a process to cancel the value added to counter value H by the processing of S71 to S81 in the current print job. This is for the purpose of, in the case of intermittent printing, causing the process to go to S75 in the process of S74 to determine the execution frequency of the cleaning mode so as not to increase the execution frequency of the cleaning mode in the next received print job.

In S85, controller 551 determines cleaning mode execution frequency parameter M, which is determined in accordance with whether the current print job is an intermittent print job, to be parameter h (S85).

When counter value A is larger than parameter s in S82, controller 551 determines cleaning mode execution frequency parameter M to be parameter i (S83). As shown in FIG. 11, parameter h>parameter i. In the case of an intermittent printing (that is, counter value A>parameter s), cleaning mode execution frequency parameter M is determined to be parameter i so as to reduce the execution frequency of the cleaning mode. The execution frequency of the cleaning mode can be changed in accordance with whether the current print job is an intermittent print.

Herein, a first execution frequency value indicates h×y of M×y. A fourth execution frequency value indicates i×y of M×y.

In S86, controller 551 compares counter value G with M×y. When counter value G>=M×y, the process goes to S87, and when counter value G<M×y, the process goes to S89.

When counter value G>=M×y, the cleaning mode is executed in S87, and counter value G is cleared (S88). Counter value A is then cleared (S89), and then the process is terminated.

When counter value G<M×y in S86, the cleaning mode is not executed, and counter value A is then cleared (S89). The process is then terminated.

In the case where a conventional image formation apparatus regularly activates the cleaning mode in the LL environment, the execution frequency of the cleaning mode is not high enough, and it is found that extraneous matter (external additives) adheres to the surface of charge roller 102 to form one or more vertical white streaks in the prints.

However, in image formation apparatus 10A according to the second embodiment, the execution frequency of the cleaning mode can be set high even in the LL environment in accordance with the operation flow shown in FIG. 9. It is found that extraneous matter adhered to the surface of charge roller 102 is reduced. The image quality can therefore be improved.

In image formation apparatus 10A according to the second embodiment, moreover, the execution frequency of the cleaning mode can be set high even at intermittent printing by the operation flow shown in FIG. 9. It is found that extraneous matter adhered to the surface of charge roller 102 is reduced. The image quality can therefore be improved.

(B-3) Effect of the Second Embodiment

As described above, according to the second embodiment, the execution frequency of the cleaning mode can be optimized in accordance with the environment and also can be optimized in accordance with whether the current print job is an intermittent print job without changing the conventional hardware configuration.

Consequently, it is possible to determine an optimal execution frequency of the cleaning mode in accordance with the situation of the image formation apparatus and prevent degradation of images due to extraneous matter adhered to the surface of the charge roller.

(C) Other Embodiment

The description of the above described embodiments includes various modifications, but the invention is also applicable to the following modifications.

(C-1)

In each of the above-described embodiments, the invention is applied to electrophotographic printers. The invention is not limited thereto and is applicable to a wide variety of electrophotographic MFPs, facsimiles, and the like.

(C-2)

In the first embodiment, the execution frequency of the cleaning mode is set to once for each continuous printing of 60 pages or once for each continuous printing of 12 pages. However, the execution frequency of the cleaning mode is not limited thereto.

(C-3)

In the second embodiment, the table of FIG. 10 for determining the environmental value and the parameter table of FIG. 11 are shown just by way of example. FIGS. 10 and 11 are not limited thereto.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus, comprising:

an image carrier;

a charge device configured to uniformly charge a surface of the image carrier;

a development device configured to pass a developer to an electrostatic latent image on the image carrier formed by exposure;

a transfer device configured to transfer a developer image formed on the image carrier onto a medium;

a remover device configured to remove the developer on the image carrier; and a controller configured to control a cleaning mode for removing extraneous matter adhered to a surface of the charge device at a time other than a time for a process of exposing the image carrier, and to change an execution frequency of the cleaning mode in accordance with an environmental condition.

2. The image formation apparatus according to claim 1, wherein the controller is configured to set the execution frequency of the cleaning mode high when the environmental condition comprises a low-humidity environment.

3. The image formation apparatus according to claim 1, wherein the controller is configured to set the execution frequency of the cleaning mode low when the environmental condition comprises a high-temperature environment.

4. The image formation apparatus according to claim 1, wherein when the environmental condition is not of a normal-temperature and normal-humidity environment, but is of a low-temperature and low-humidity environment or a high-temperature and high-humidity environment, the controller is configured to set the execution frequency of the cleaning mode lower than that in the normal-temperature and normal-humidity environment.

5. The image formation apparatus according to claim 4, wherein when the environmental condition is not of a normal-temperature and normal-humidity environment, but is of a low-temperature and low-humidity environment, the controller is configured to set the execution frequency of the cleaning mode lower than that in the high-temperature and high-humidity environment.

6. The image formation apparatus according to claim 1, wherein the controller holds history information of the number of prints counted at printing and is configured to change the execution frequency of the cleaning mode based on the history information of the number of prints counted.

7. The image formation apparatus according to claim 1, wherein the controller holds history information of the number of jobs counted at printing and is configured to change the execution frequency of the cleaning mode based on the history information of the number of jobs counted.

8. The image formation apparatus according to claim 1, wherein a pressing force of the remover device against the image carrier is 10.1 gf/cm to 29.1 gf/cm, both inclusive, and the developer includes an external additive having an opposite polarity to a bias applied to the charge device during printing.

9. The image formation apparatus according to claim 1, wherein in the cleaning mode controlled by the controller, extraneous matter adhered to the charge device has a surface potential of not lower than +1 V and not higher than +10 V on the charge device.

10. The image formation apparatus according to claim 1, wherein the controller holds a job number-of-print counter value representing the number of pages continuously printed from a start of a print job, a number-of-print counter value representing the number of pages printed after an end of a previous cleaning mode, and a total number-of-print counter value representing the number of pages printed after the image formation apparatus is powered on or is awoken from a sleep mode, and the controller comprises:

a threshold determination portion configured to calculate a threshold to determine the execution frequency of the cleaning mode in accordance with an environmental value determined based on temperature and humidity; and an execution portion configured to execute the cleaning mode at a frequency determined based on results of a comparison of the job number-of-print counter value, the number-of-print counter value, and the total number-of-print counter value with the threshold determined by the threshold determination portion.

11. The image formation apparatus according to claim 10, wherein the execution portion of the controller is configured to:

execute the cleaning mode based on a comparison of a first execution frequency value with the number-of-print counter value when the job number-of-print counter value is not more than the threshold, and execute the cleaning mode based on a comparison of a second execution frequency value with the number-of-print counter value when the job number-of-print counter value is more than the threshold, the second execution frequency value being less than the first execution frequency value.

12. The image formation apparatus according to claim 11, wherein the first and second execution frequency values are larger when the temperature is between predetermined high and low temperatures and the humidity is between predetermined high and low humidities, than when the temperature is below the predetermined low temperature and the humidity is below the predetermined low humidity or when the temperature is equal to or above the predetermined high temperature and the humidity is equal to or above the predetermined high humidity.

13. The image formation apparatus according to claim 11, wherein when the job number-of-print counter value is not more than the threshold, the execution portion of the controller executes the cleaning mode based on a comparison of a third execution frequency value with the number-of-print counter value, and when the job number-of-print counter value is more than the threshold, the execution portion compares a fourth execution frequency value with the number-of-print counter value and executes the cleaning mode if the number-of-print counter value is not less than the fourth execution frequency value and the number-of-print counter value is not less than a fifth execution frequency value.

14. The image formation apparatus according to claim 13, wherein the third, fourth, and fifth execution frequency values are larger when the temperature is between predetermined high and low temperatures and the humidity is between predetermined high and low humidities than when the temperature is below the predetermined low temperature and the humidity is below the predetermined low humidity or when the temperature is equal to or above the predetermined high temperature and the humidity is equal to or above the predetermined high humidity.

15. The image formation apparatus according to claim 10, wherein the threshold determination portion of the controller holds environmental value determination information based on combinations of temperature and humidity and is configured to determine the environmental value based on a detected temperature and humidity with reference to the environmental value determination information.

16. The image formation apparatus according to claim 10, wherein the threshold determination portion of the controller holds threshold determination information to determine the threshold in accordance with the environmental value and is configured to determine the threshold value in accordance with the environmental value with use of the threshold determination information.

* * * * *